US008682467B2

(12) United States Patent
Ihira et al.

(10) Patent No.: US 8,682,467 B2
(45) Date of Patent: Mar. 25, 2014

(54) EMBROIDERY DATA GENERATING DEVICE, COMPUTER-READABLE STORAGE MEDIUM STORING EMBROIDERY DATA PROCESSING PROGRAM AND SEWING MACHINE

(75) Inventors: Yuki Ihira, Kakamigahara (JP); Ryutaro Maki, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 47 days.

(21) Appl. No.: 13/605,255

(22) Filed: Sep. 6, 2012

(65) Prior Publication Data

US 2013/0079915 A1 Mar. 28, 2013

(30) Foreign Application Priority Data

Sep. 27, 2011 (JP) ..... 2011-210758

(51) Int. Cl.
*D05C 5/02* (2006.01)

(52) U.S. Cl.
USPC ..... 700/138; 112/470.01

(58) Field of Classification Search
USPC ..... 700/136–138; 112/470.01, 470.04, 112/470.06, 475.18, 475.19
See application file for complete search history.

(56) References Cited

U.S. PATENT DOCUMENTS

| | | | | |
|---|---|---|---|---|
| 4,869,188 | A * | 9/1989 | Hyodo | 112/470.04 |
| 5,410,976 | A * | 5/1995 | Matsubara | 112/470.06 |
| 5,740,057 | A * | 4/1998 | Futamura | 700/138 |
| 6,012,402 | A * | 1/2000 | Sekine | 112/470.04 |
| 6,304,793 | B1 * | 10/2001 | Komiya et al. | 700/138 |
| RE38,718 | E * | 3/2005 | Futamura | 700/138 |
| 6,980,877 | B1 * | 12/2005 | Hagino et al. | 700/138 |
| 7,542,822 | B2 * | 6/2009 | Kawaguchi et al. | 700/138 |

FOREIGN PATENT DOCUMENTS

JP A-7-100277 4/1995

* cited by examiner

*Primary Examiner* — Nathan Durham
(74) *Attorney, Agent, or Firm* — Oliff PLC

(57) ABSTRACT

An embroidery data generating device generates embroidery data usable to sew by a sewing machine an embroidery pattern composed of a plurality of color-based pattern portions. The device includes a color data storage unit storing data of a plurality of defined colors, an assignment unit randomly extracting a color from the color data stored on the color data storage unit, the extracted color being used as thread color data for specifying colors of the color-based pattern portions respectively, the assignment unit assigning the extracted colors to the respective color-based pattern portions and a sewing sequence data storage unit storing data of set sewing sequence of the color-based pattern portions. The device generates embroidery data in which an order of contrasting density of the colors assigned to the respective color-based pattern portions by the assignment unit as the thread color data corresponds to a sewing sequence of the color-based pattern portions.

17 Claims, 16 Drawing Sheets

| VALUE [%] OF HSV SATURATION S | CONTRASTING DENSITY LEVEL LV |
|---|---|
| $0 \sim U_c\ (=\frac{S}{c})$ | 1 |
| $U_c \sim 2U_c$ | 2 |
| ⋮ | ⋮ |
| $(c-1)U_c \sim 100$ | c |

| EMBROIDERY DATA | |
|---|---|
| FIRST PATTERN PORTION DATA | PATTERN 1 PURPLE |
| | Xa0,Ya0 |
| | Xa1,Ya1 |
| | Xa2,Ya2 |
| | ⋮ |
| | XaN,YaN |
| SECOND PATTERN PORTION DATA | PATTERN 2 ROSE |
| | Xb0,Yb0 |
| | Xb1,Yb1 |
| | Xb2,Yb2 |
| | ⋮ |
| | XbN,YbN |
| ⋮ | ⋮ |
| ⋮ | ⋮ |
| x-TH PATTERN PORTION DATA | PATTERN x MAGENTA |
| | Xx0,Yx0 |
| | Xx1,Yx1 |
| | Xx2,Yx2 |
| | ⋮ |
| | XxN,YxN |

FIG. 4

| VALUE [%] OF HSV SATURATION S | CONTRASTING DENSITY LEVEL LV |
|---|---|
| $0 \sim U_c \ (= \frac{S}{c})$ | 1 |
| $U_c \sim 2U_c$ | 2 |
| ⋮ | ⋮ |
| $(c-1)U_c \sim 100$ | c |

| | OVERLAP SEQUENCE |
|---|---|
| FIRST PATTERN PORTION | 1 |
| SECOND PATTERN PORTION | 2 |
| THIRD PATTERN PORTION | 2 (OR 3) |
| FOURTH PATTERN PORTION | 3 (= c) |

| VALUE [%] OF HSV SATURATION S | CONTRASTING DENSITY LEVEL LV |
|---|---|
| $0 \sim U_X \ (=\frac{S}{X})$ | 1 |
| $U_X \sim 2U_X$ | 2 |
| $2U_X \sim 3U_X$ | 3 |
| ⋮ | ⋮ |
| $(i-1)U_X \sim iU_X$ | i |
| $iU_X \sim (i+1)U_X$ | i+1 |
| ⋮ | ⋮ |
| $(x-1)U_X \sim 100$ | x |

FIG.13

EMBROIDERY DATA GENERATING DEVICE, COMPUTER-READABLE STORAGE MEDIUM STORING EMBROIDERY DATA PROCESSING PROGRAM AND SEWING MACHINE

CROSS-REFERENCE TO RELATED APPLICATIONS

This application is based upon and claims the benefit of priority from the prior Japanese Patent Application No. 2011-210758 filed on Sep. 27, 2011, the entire contents of which are incorporated herein by reference.

BACKGROUND

1. Technical Field

The present disclosure relates to an embroidery data generating device which generates embroidery data of an embroidery pattern composed of a plurality of color-based pattern portions, a computer-readable storage medium which stores an embroidery data processing program, and a sewing machine.

2. Related Art

There have conventionally been provided sewing machines which sew an embroidery pattern based on embroidery data. In one of the sewing machines, a plurality of embroidery patterns is stored on an internal storage device or an external storage device such as a ROM card or flexible disc. A user selects a desirable one of the embroidery patterns. In the sewing machine, embroidery data of the selected embroidery pattern is read, and the embroidery pattern is sewn on a workpiece cloth while an embroidery frame holding the workpiece cloth is transferred by a transfer mechanism.

Embroidery data of an embroidery pattern composed of a plurality of color-based pattern portions includes thread color data for identifying colors of the respective color-based pattern portions. The color-based pattern portions are sewn by the use of colors (thread colors) set as thread color data respectively. For example, an embroidery pattern of girl's head with ribbons includes a plurality of color-based pattern portions of face, hair, ribbons, eyes, eyebrows, nose, mouth, ears etc. These plural color-based pattern portions are sewn by the use of a plurality of thread colors respectively. Furthermore, the embroidery data is set so that the color-based pattern portions such as "eyes" or "eyebrows" are sewn so as to overlap the color-based pattern portion of "face" after the entire region of "face" has been sewn. Thus, the color-based pattern portion of "face" is not sewn on a part of the workpiece cloth except for portions of "eyes" and "eyebrows" to be sewn. Accordingly, the color-based pattern portions of "eyes" and "eyebrows" are sewn so as to overlap with the color-based pattern portion of "face." This embroidery sewing manner results in a distinguished-looking embroidery pattern without gaps in a boundary between color-based pattern portions. Furthermore, a color-based pattern portion of "ribbons" is sewn so that a part or entire of "ribbons" overlaps with a sewn part of "hair."

Assume now that the aforementioned "hair" is colored dark brown and the ribbons are colored white. Thus, when the color-based pattern portion of "hair" to be firstly sewn is darker than the color-based pattern portion of "ribbons" to be subsequently sewn, an embroidery thread of "hair" located under an embroidery thread of "ribbons" is sometimes visible through the upper embroidery thread of "ribbons." This would reduce the quality of embroidery pattern.

In view of the above-described drawback, the conventional art has proposed an embroidery data generating device which is configured to correct the thread color data so that a first thread color of the color-based pattern portion to be sewn later in the sewing sequence becomes darker than a second thread color of the color-based pattern portion to be sewn earlier. In this case, the thread color of the color-based pattern portion to be sewn earlier is corrected into a darker color than the color-based pattern portion to be sewn later in the overlapping color-based pattern portions.

However, the user does not sometimes wish the colors of the color-based pattern portions to be constrained by the colors of other color-based pattern portions and sometimes desires to sew one or more color-based pattern portions in favorite or extraordinary colors, instead of specified colors. However, in order that the colors of the color-based pattern portions may be designated in the above-described manner, data of color-based pattern portions needs to be read one by one for confirmation or designation of corresponding thread color data. This results in time-consuming and troublesome work.

SUMMARY

Therefore, an object of the disclosure is to provide an embroidery data generating device which can easily execute coloration of an embroidery pattern and can obtain various coloration patterns while the quality of the embroidery patterns can be ensured, an embroidery data processing program on which the embroidery data generating device can run and a sewing machine which is provided with the embroidery data generating device internally or externally.

The disclosure provides an embroidery data generating device which generates embroidery data usable to sew by a sewing machine an embroidery pattern composed of a plurality of color-based pattern portions, the device comprising a color data storage unit which stores data of a plurality of defined colors; an assignment unit which randomly extracts colors from the colors stored on the color data storage unit, the extracted colors being used as thread color data for specifying colors of the color-based pattern portions respectively, the assignment unit assigning the extracted colors to the respective color-based pattern portions; and a sewing sequence data storage unit which stores data of a set sewing sequence of the color-based pattern portions, the device generating embroidery data in which an order of contrasting density of the colors assigned to the respective color-based pattern portions by the assignment unit as the thread color data corresponds to a sewing sequence of the color-based pattern portions.

BRIEF DESCRIPTION OF THE DRAWINGS

In the accompanying drawings:

FIG. 4 exemplifies embroidery data;

FIG. 13 is a view similar to FIG. 9, showing a second example;

DETAILED DESCRIPTION

Figure 1:
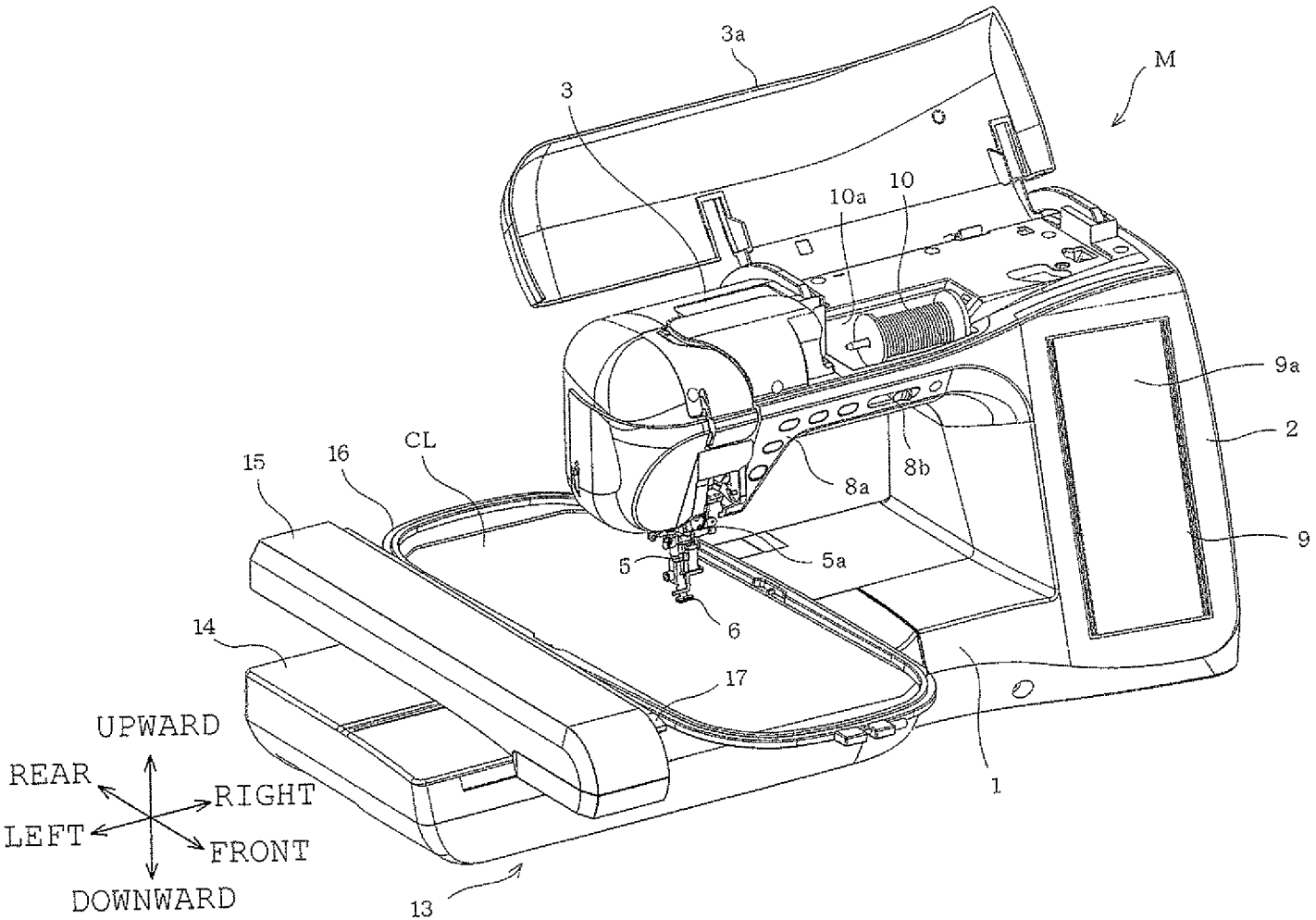
FIG. 1 is an overall perspective view of the sewing machine in accordance with a first example.

A first example applied to a household sewing machine (hereinafter, "sewing machine M") will be described with reference to FIGS. 1 to 12. Referring to FIG. 1, the sewing machine M includes a bed 1 extending in a right-left direction, a pillar 2 rising upward from a right end of the bed 1 and an arm 3 extending leftward from an upper part of the pillar 2 all of which are formed integrally with one another. A sewing machine shaft (not shown) is housed in the arm 3 so as to extend in the right-left direction, and a sewing machine motor 4 (see FIG. 2) is also housed in the arm 3 to rotate the machine shaft. The side where the user is located relative to the sewing machine M will be referred to as "front" and the side opposed to the front will be referred to as "rear." The side where the pillar 2 is located will be referred to as "right side" and the side opposite the right will be referred to as "left side" with respect to the sewing machine M.

The arm 3 has a distal end on which are mounted a needle bar 5*a* attached with a needle 5 and a presser bar (not shown) provided with a presser foot 6. The arm 3 also houses a needle bar driving mechanism which moves the needle bar upward and downward based on rotation of the machine shaft and a needle bar swinging mechanism which swings the needle bar in a direction (the right-left direction) perpendicular to a cloth feed direction. The arm 3 further houses a needle thread take-up driving mechanism which moves a needle thread take-up (not shown) upward and downward in synchronization with the upward and downward movement of the needle bar, a presser bar driving mechanism which moves the presser bar upward and downward, and the like.

The arm 3 is provided with a cover 3*a* which is pivotally mounted thereon so as to open and close an upper surface side of the arm 3. An accommodating space is defined in the central front of the arm 3 so as to accommodate a thread spool 10 when the cover 3*a* is in an open state. A needle thread drawn from the thread spool 10 is supplied through a thread supply passage including the needle thread take-up and the like to the needle 5.

On the front side of the arm 3 are mounted various switches including a start/stop switch 8*a* which is operable to start or stop a sewing work. A speed adjusting knob 8*b* is also mounted on the front side of the arm 3 to adjust a sewing speed or a rotational speed of the machine shaft. A large sized vertically long display 9 capable of full color display is mounted on the front of the pillar 2. The display 9 may be a liquid crystal color display, for example. The display 9 is configured to display various sewing patterns such as ordinary patterns or embroidery patterns, names of functions to be executed in the sewing work, a setting screen for setting colors of an embroidery pattern as will be described later (see FIG. 5). Furthermore, the display 9 has a front to which is mounted a touch panel 9*a* (see FIG. 2) having a plurality of touch keys including transparent electrodes. When touch keys are depressed by user's finger or a touch pen (not shown), selection of a sewing pattern, instruction of various functions, setting of various parameters or the like are executable. The pillar 2 has a right side surface in which is formed a card slot 12 into which is insertable a memory card 11 (shown only in FIG. 2) storing embroidery data of various embroidery patterns and the like.

The bed 1 has an upper surface on which a needle plate (not shown) is mounted. The bed 1 houses a cloth feed mechanism which is located under the needle plate to move a feed dog vertically and horizontally, a horizontal rotating hook accommodating a bobbin and forming stitches in cooperation with the needle 5, and a thread cutting mechanism which cuts the needle thread and the bobbin thread.

An embroidery frame transfer device 13 is detachably attached to a left part of the bed 1. The embroidery frame transfer device 13 includes a body 14 that is level with the upper surface of the bed 1 and a movable portion 15 which is mounted on an upper surface of the body 14 so as to be movable in the right-left direction. The movable portion 15 is provided with a carriage 17 which is movable in the front-back direction to detachably connect an embroidery frame 16 thereto. The embroidery frame 16 is configured to hold a workpiece cloth CL serving as an object to be sewn. The embroidery frame transfer device 13 includes an X-direction transfer mechanism (not shown) which moves the carriage 17 in the right-left direction together with the movable portion 15 and a Y-direction transfer mechanism (not shown) which moves the carriage 17 in the front-back direction. The embroidery frame 16 is moved in the right-left or X direction and in the front-back or Y direction by driving drive motors of the respective X-direction and Y-direction transfer mechanisms (an X-axis motor 18 and a Y-axis motor 19 as will be described later; and see FIG. 2) on the basis of the embroidery data of the embroidery pattern.

Figure 2:
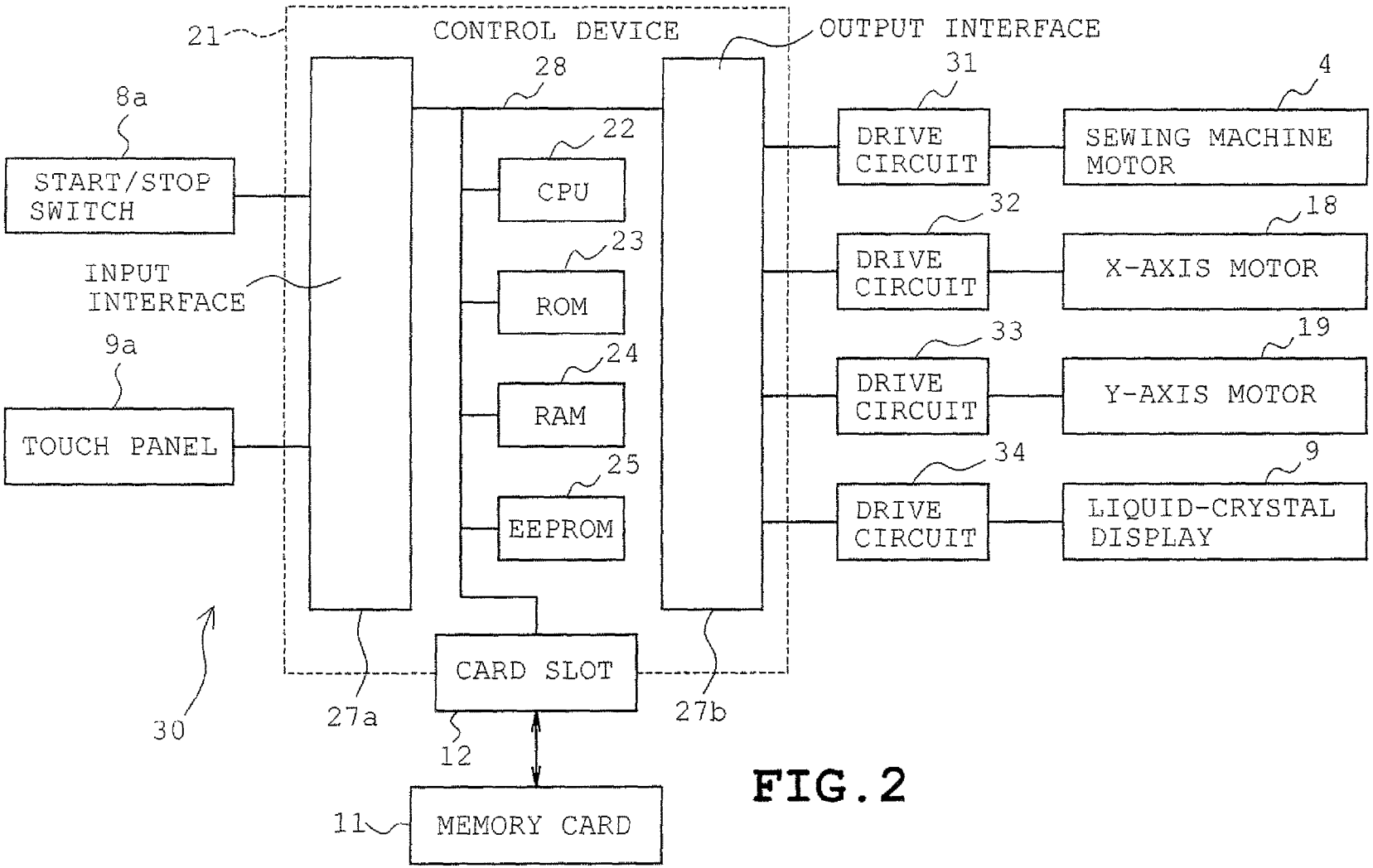
FIG. 2 is a block diagram showing an electrical arrangement of the machine.

The arrangement of the control system of the sewing machine M will now be described with reference to the block diagram of FIG. 2. A control device 21 is configured mainly with a microcomputer and incorporates a CPU 22, a ROM 23, a RAM 24, an EEPROM 25, the card slot 12, input/output (I/O) interfaces 27*a* and 27*b* and a bus bar 28 connecting between the I/O interfaces 27*a* and 27*b*. The start/stop switch 8*a* and the touch panel 9*a* are connected to the input interface 27*a*. To the output interface 27*b* are connected drive circuits 31, 32, 33 and 34 driving the machine motor 4, the X-axis motor 18, the Y-axis motor 19 and the display 9 respectively. The control device 21, the display 9 and the drive circuit 34 serve as a display unit. An embroidery data generator 30 is constituted by the control device 21, the touch panel 9*a*, the display 9, the drive circuit 34 and the like.

The ROM 23 stores embroidery data, a sewing control program, a table of full thread information that relates to a plurality of types of threads used for embroidery sewing and includes thread color information, thread numbers and the like as will be described later. The ROM 23 also stores a display control program for controlling the liquid crystal display 9. The ROM 23 further stores an embroidery data processing program on which the computer functions as various processing units for generation of embroidery data. These programs and data may be stored on an internal storage unit such as the EEPROM 25 or an external storage unit such as the memory card 11. For example, when the embroidery data processing program is stored on the external storage unit, the control device 21 reads the program onto the RAM 24 to execute the program.

Figure 3:
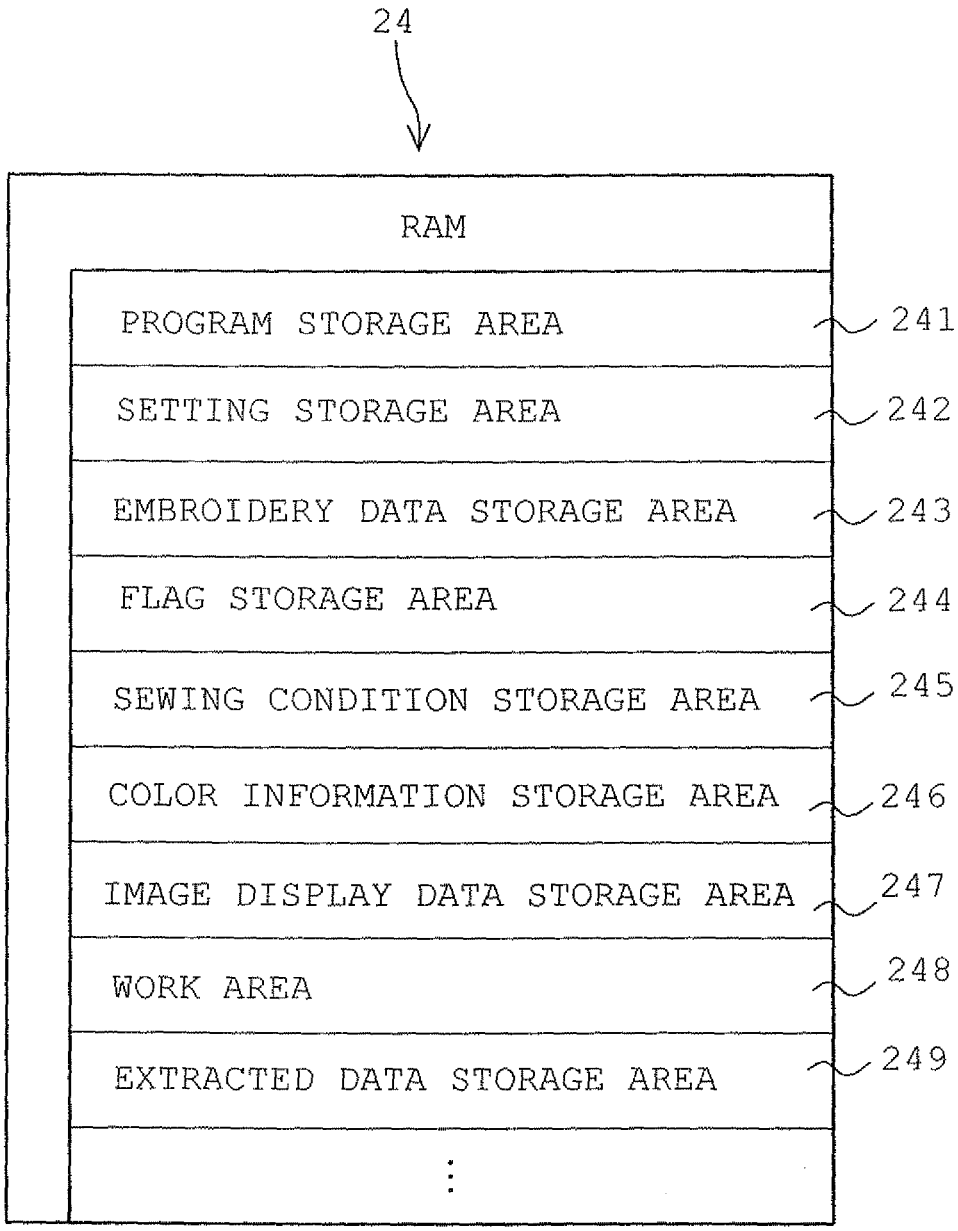
FIG. 3 schematically shows storage areas of a RAM of the machine.

The RAM 24 has a storage area for temporarily storing, as a storage unit, the aforementioned programs and data, various settings input by operation of the touch panel 9*a* or the like, results of an operation carried out by the control device 21, and the like. More specifically, as shown in FIG. 3, the RAM 24 has a plurality of storage areas including a program storage area 241, a setting storage area 242, an embroidery data storage area 243, a flag storage area 244, a sewing condition storage area 245, a color information storage area 246, an image display data storage area 247, a work area 248, an extracted data storage area 249 and the like. The program storage area 241 stores various programs read from the ROM 23 or the like. The setting storage area 242 stores settings, tables and the like referred to during execution of a program. The embroidery data storage area 243 stores data serving as an original or a reference value in generation of embroidery data. The flag storage area 244 stores various flags used in execution of a program. The sewing condition storage area 245 stores data of various sewing conditions in the case of sewing an embroidery pattern.

The color information storage area 246 is provided with a contrasting-density-based buffer which stores data used for coloration of an embroidery pattern. The contrasting-density-based buffer is configured as a storage area storing the data divided into a plurality of groups having respective contrasting densities as will be described in more detail later. Furthermore, the extracted data storage area 249 primarily stores data of a randomly extracted color. The image display data storage area 247 stores image data of screens to be displayed on the display 9 and display settings. The work area 248 preliminarily stores settings and the like during execution of various programs.

Figure 7:
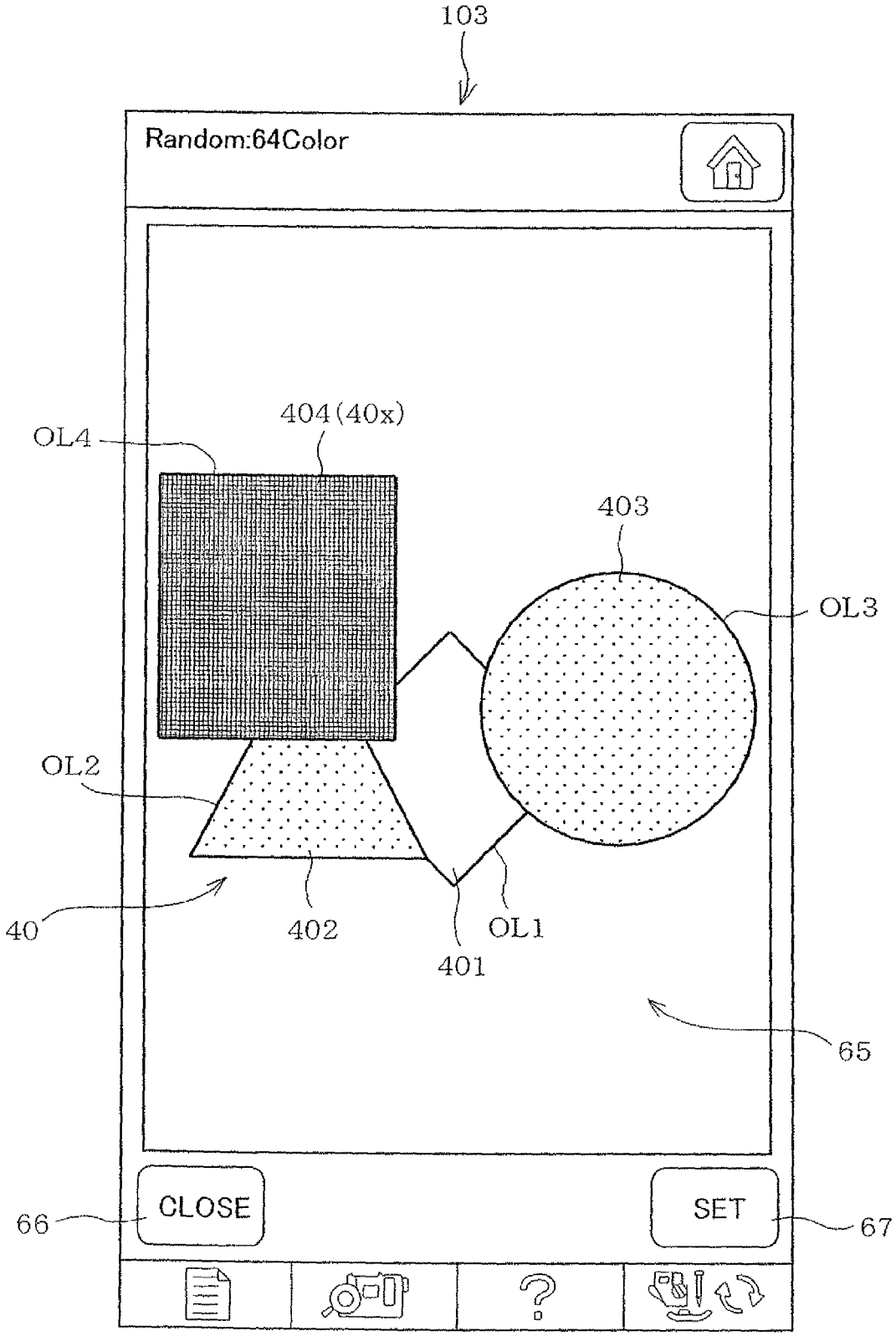
FIG. 7 exemplifies an enlarged display screen.
Figures 8, 9:
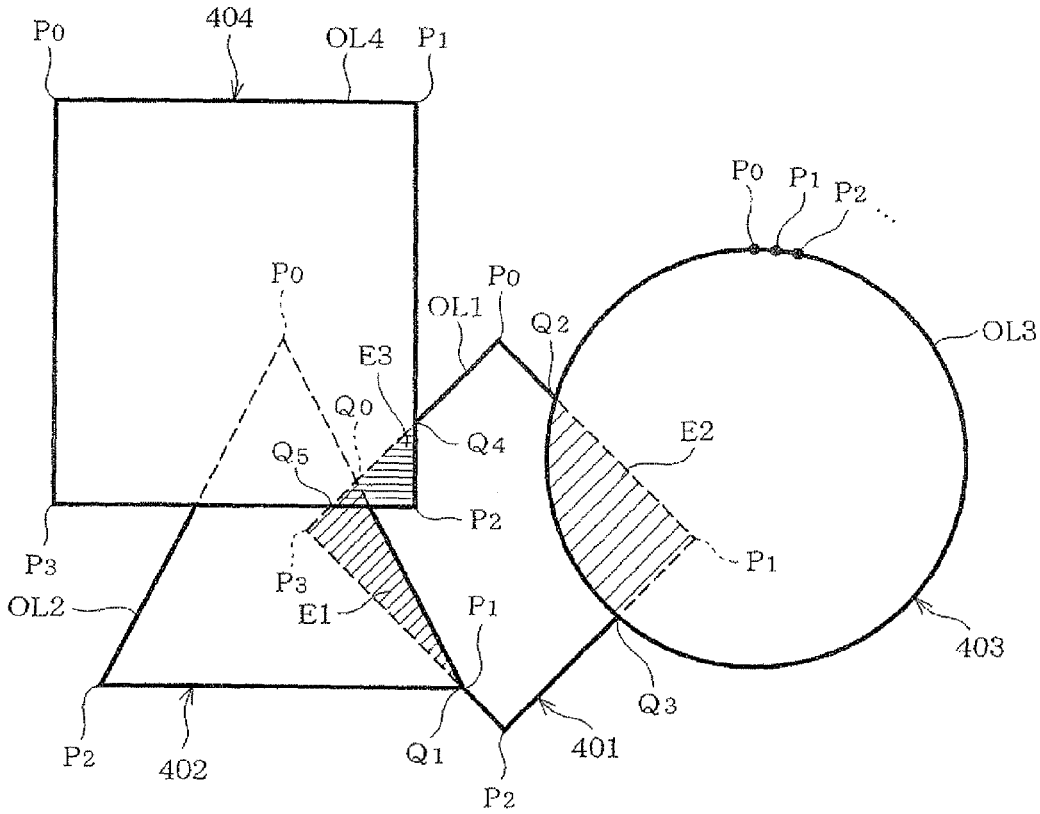
FIG. 8 is an enlarged view of pattern-by-color portions overlapping each other.
FIG. 9 exemplifies a contrasting density level table.

An embroidery pattern 40 displayed on the screen 103 of the display 9 as shown in FIG. 7 will be described as an example of embroidery pattern. The embroidery pattern 40 includes first to x-th color-based pattern portions 401 to 40*x* which are a plurality of (x number of) color-based pattern portions. More specifically, the first to fourth pattern portions 401 to 404 are four geometric patterns of smaller rectangular, triangular, circular and larger rectangular shapes respectively as also shown in FIG. 8. The shapes of the first to fourth pattern portions 401 to 404 represent sewing areas having respective outlines OL1 to OL4. Stitches are to be formed inside the outlines OL1 to OL4 so as to fill up the respective sewing areas. Furthermore, the color-based pattern portions are arranged so as to at least partially overlap therebetween or thereamong in the embroidery pattern 40 as shown by hatching in FIG. 8. The first rectangular pattern portion 401 is to be sewn by the use of a purple thread. The second triangular pattern portion 402 is to be sewn by the use of a rose thread. The third circular pattern portion 403 is to be sewn by the use of a red thread. The fourth rectangular pattern portion 404 is to be sewn by the use of a magenta thread. The colors of the color-based pattern portions 401 to 404 are thus set and need not be different from one another.

Embroidery data is used for the sewing machine M to sew an embroidery pattern and includes data of a plurality of color-based pattern portions. For example, as shown in FIG. 4, embroidery data of the embroidery pattern 40 includes data of a plurality of needle locations set for respective pattern portions 401 to 40*x* (404), sewing order data to specify a sewing order of the pattern portions 401 to 40*x* (patterns 1 to x) and thread color data. The thread color data is used to specify a color for every color-based pattern portion, and a color is assigned from color information to the thread color data by an assignment unit which will be described later.

Sewing sequence data "pattern 1" on the top of FIG. 4 specifies a first sewing, and "purple" corresponding to "pattern 1" is actually thread color data shown by RGB values, for example. Furthermore, needle location data "XaO, YaO" "XaN, YaN" indicates coordinates of needle locations of a needle corresponding to the thread color of "purple". In the same manner, embroidery data for second and subsequent sewing also include sewing sequence data "pattern 2" to "pattern x," thread color data "rose" to "magenta" and needle location data "XbN, YbN to XnN, YnN." The embroidery data also includes image data (an image in a BMP format, for example; and not shown) displayed on the display 9, and an image of embroidery pattern is displayed on the display 9 in the colors allotted to respective thread color data.

The EEPROM 25 stores information (color information) about a plurality of colors to be assigned as the thread color data, thus serving as a color storage unit together with the RAM 24. The color information refers to, for example, information about thread colors of the thread spool 10 usable with the sewing machine M and is defined by RGB values. More specifically, the EEPROM 25 stores a first pallet table (see a first color pallet 53 in FIG. 5) including RGB values of 64 colors and pallet-based color numbers 1 to 64 corresponding to the respective RGB values. The EEPROM 25 also stores a second pallet table (not shown) of a plurality of colors selected by the user from the color information. The second pallet table is a custom pallet table that is capable of storing RGB values of up to 300 colors and pallet-based color numbers of 1 to 300 corresponding to the respective RGB values according to user's preference.

Furthermore, HSV values are also used in this example in addition to the RGB values. The HSV values are defined by hue, saturation and value in an HSV space, corresponding to the respective RGB values. The HSV values are computed on the basis of RGB values by a known obtaining method by the control device 21 and represented by values of hue H, color saturation S and value V. In this case, the hue represents a type of color such as red, purple, blue, etc. and has a value ranging from 0 to 360, for example. The saturation represents a color vividness and has a value ranging from 0.0 to 1.0 or from 0% to 100% (see FIG. 9), for example. The value represents color brightness and has a value ranging from 0.0 to 1.0.

The generation of embroidery data, or particularly, a screen displayed on the display 9 in coloration of thread color data will be described with further reference to FIGS. 5 to 7. Display screens 100 to 104 on the display 9 will be described with reference to FIGS. 5 to 7. Since the display 9 is a liquid-crystal color display, an image of embroidery pattern on the display screens 100 to 104, the 64-color and 300-color pallets 53 and 56*a* and the like are capable of multi-color display.

Figure 5:
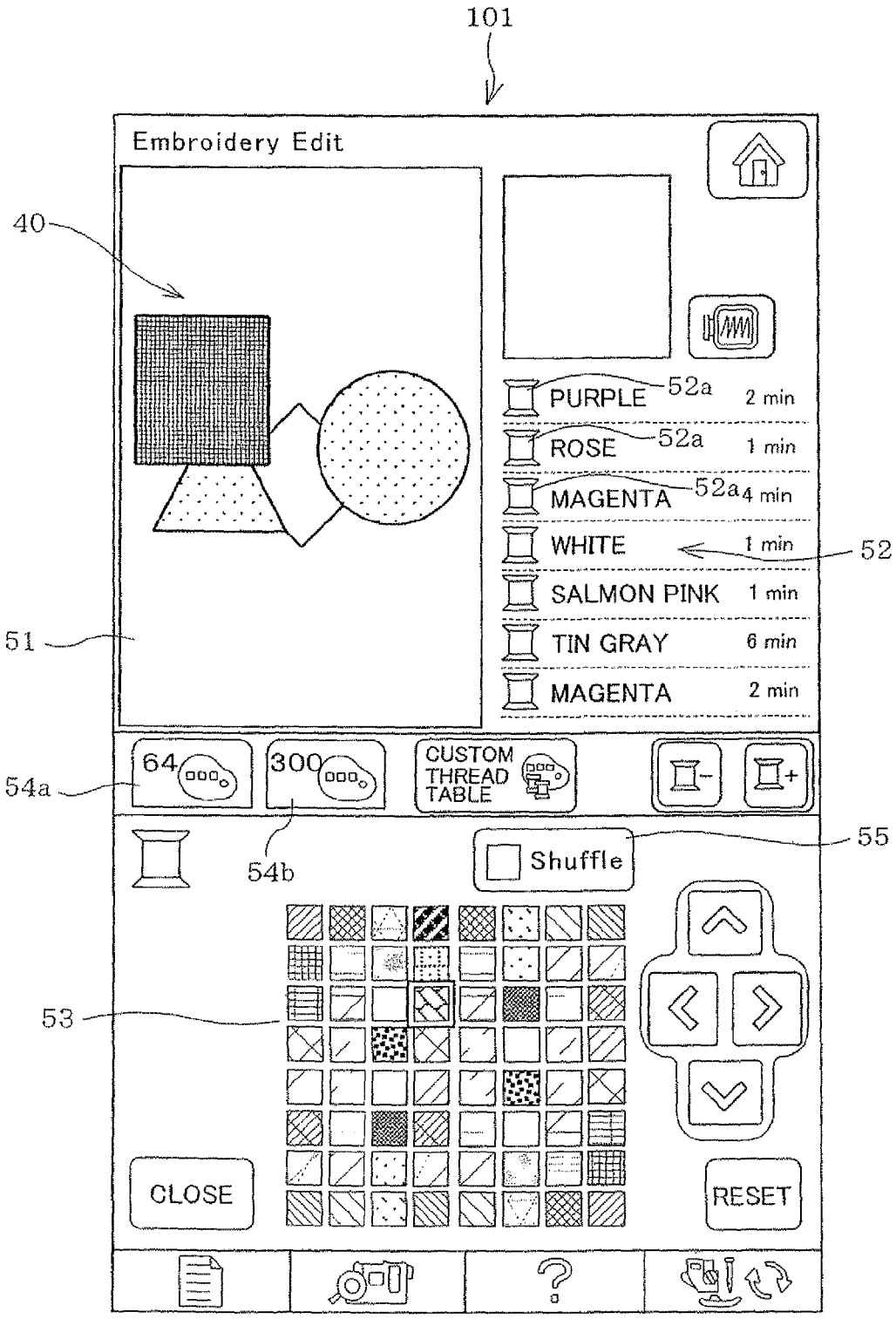
FIG. 5 exemplifies a first color change screen in generation of embroidery data.
Figure 6:
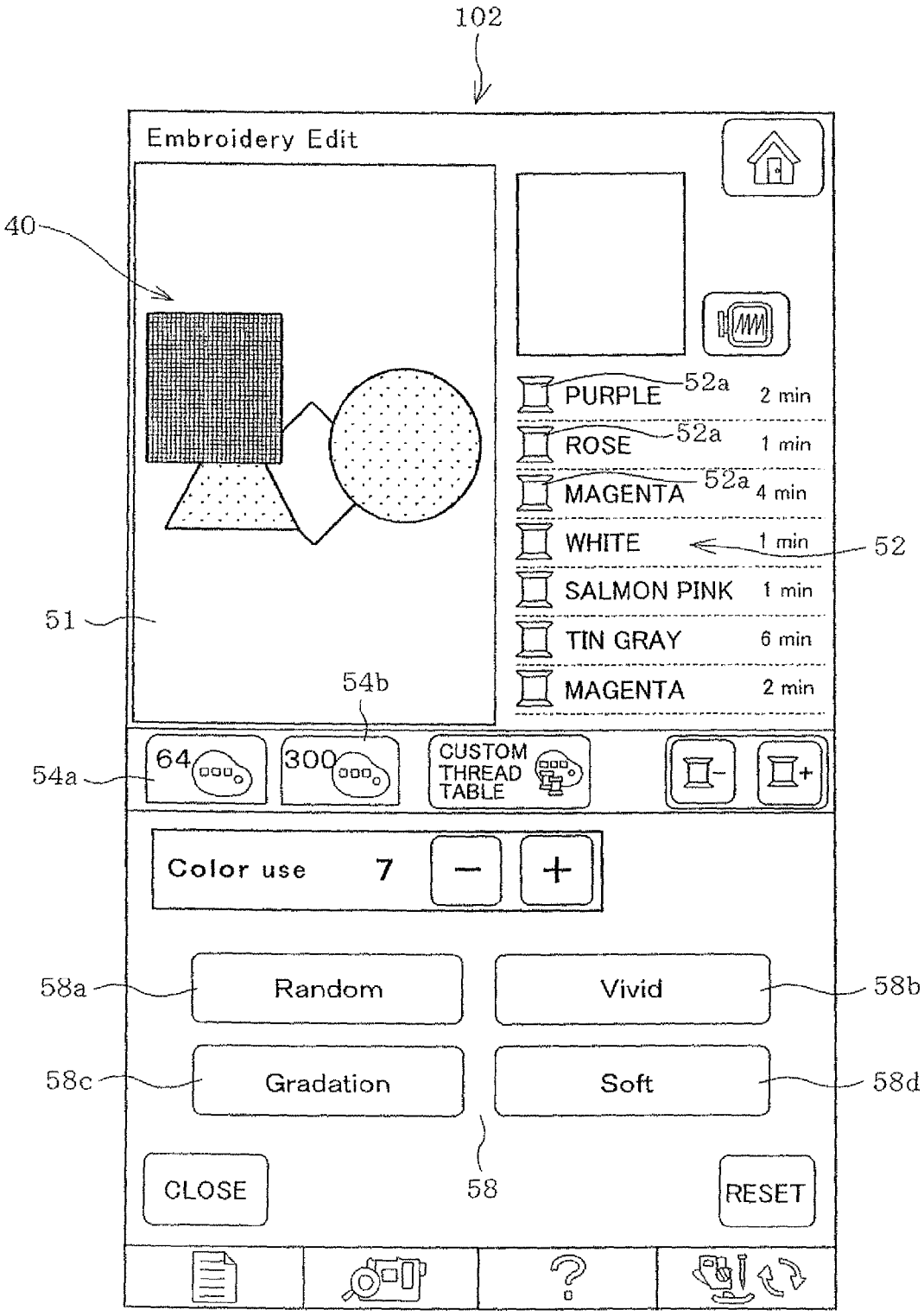
FIG. 6 exemplifies a coloration setting screen.

FIG. 5 exemplifies a first color change screen 101 displayed in the coloration of thread color data. The first color change screen 101 includes a preview image area 51 and a thread color data designation area 52 as well as the aforesaid first color pallet 53, a plurality of pallet selecting keys 54*a* and 54*b* and a SHUFFLE key 55. A preview image displayed on the preview image area 51 indicates a result of embroidering when embroidering is carried out on the basis of embroidery data corresponding to an embroidery pattern selected by the user.

Various settings relating to thread colors are executable on the first color change screen 101. More specifically, the thread color data designating area 52 shows colors corresponding to the respective color-based pattern portions in the preview image area 51 together with an illustration of the thread spools 52*a*. The user can designate a color he/she desires out of 64-color pallet 53 for every color-based pattern portion when depressing or touching the touch key. For example, RGB values of pallet-based color numbers 1 to 8 of the 64-color pallet table are assigned to a top row of the 64-color pallet 53 sequentially from the left. Thus, the 64-color pallet 53 includes eight rows each of which further includes eight thread spool color data of the 64-color pallet table.

A second color change screen provided with a second color pallet is prepared separately from the first color change screen 101 although not shown. The second color pallet is capable of arranging 300 colors on a 300-square pallet at most on the basis of the RGB values of the color information and corresponds to the second pallet table. The first and second color change screens are switched therebetween by touching a pair of pallet selecting keys 54*a* and 54*b*. When the SHUFFLE key 55 is touched, the first or second color change screen is changed to a color tone setting screen 102 as shown in FIG. 6.

The color tone setting screen 102 is provided with a preview image area 51 and the like in the same manner as the first color change screen 101. The color tone setting screen 102 is further provided with a category setting section 58 and a RANDOM key 58*a*, instead of the first color pallet 53. The RANDOM key 58*a* randomly extracts a color from one of the plural pallet tables for every thread color data to execute coloration. When the RANDOM key 58*a* is touched, an assignment process is executed to randomly extract colors to be used as thread color data and to assign the extracted colors to the respective color-based pattern portions 401 to 40*x*. The category setting section 58 includes "vivid," "gradation" and "soft" keys 58*b*, 58*c* and 58*d* respectively. The categories of "vivid," "gradation" and "soft" are used to classify the color information. A plurality of colors classified into the "vivid" category each has a higher color saturation S and is vivid. A plurality of colors classified into the "gradation" category each has a hue value within a predetermined range with a hue value H of a predetermined color as a center value. A plurality of colors classified into the category of "soft" is each rarely different from the color saturation S and gives a soft impression.

The display 9 is changed to an enlarged display screen 103 as shown in FIG. 7 after the assignment process has been executed by touching the RANDOM key 58*a*. The enlarged display screen 103 includes an enlarged image area 65, a close key 66 and a set key 67. An enlarged embroidery pattern in colors assigned by the assignment process is displayed on the enlarged display area 65. When the close key 66 is touched, the display 9 is returned to the color tone setting screen 102. Furthermore, when the set key 67 is touched, embroidery data of the displayed embroidery pattern is stored on the EEPROM 25 and the display 9 is returned to the first color change screen 101.

When the color-based pattern portions 401 to 404 overlap with each other at least partially as the case of the aforesaid embroidery pattern 40, stitches can tightly be formed between the overlapping color-based pattern portions 401 to 404. More specifically, since the first, second and fourth color-based pattern portions 401, 402 and 404 have overlapping portions (see hatched parts in FIG. 8), no gap is produced along outlines between the color-based pattern portions 401, 402 and 404. Furthermore, since the first and third color-based pattern portions 401 and 403 overlap, no gap is produced along outlines between the first and third color-based pattern portions 401 and 403. However, when the thread color of the first color-based pattern portion 401 is darker than the thread colors of the second to fourth color-based pattern portions 402 to 404, the thread of the first color-based pattern portion 401 sewn on the workpiece cloth CL is sometimes viewed through the threads of the other color-based pattern portions 402 to 404, with the result of possible reduction in the quality of the embroidery pattern.

In view of the foregoing drawback, the control device 21 generates embroidery data in which regarding the overlapping color-based pattern portions, an order of contrasting density of the colors assigned to the respective color-based pattern portions by the assignment unit as the thread color data corresponds to a sewing sequence of the color-based pattern portions. Consequently, a predetermined coloration corresponding to the sewing sequence of the color-based pattern portions can easily be obtained while the aforesaid color designation by the user is unnecessary.

More specifically, the control device 21 refers to the needle location data in order to determine whether or not the color-based pattern portions overlap with each other, thereby extracting data of imaginary lines showing outlines OL1 to OL4. For example, the control device 21 extracts coordinate values of four corner points $P_0$, $P_1$, $P_2$ and $P_3$ of the first color-based pattern portion 401 in a sewing area or line segment data of an imaginary line (an outline OL1) obtained by connecting the coordinate points $P_0$ to $P_3$ by straight lines. Furthermore, when the outline OL3 includes a curved line as the third color-based pattern portion 403, the control device 21 extracts coordinate values of folding points $P_0$, $P_1$, . . . obtained by substituting a finite number of straight lines with the curved line.

Alternatively, the control device 21 extracts line segment data of an imaginary line connecting the folding points $P_0$, $P_1$, . . . together by straight lines.

The control device 21 then detects occurrence of an intersection of imaginary lines based on the line segment data of the color-based pattern portions 401 to 404, thereby determining overlap of the color-based pattern portions 401 to 404. The control device 21 is configured to detect, as an overlap number, the number of overlaps of the color-based pattern portions 401 to 404, based on the result of determination about the overlap. Alternatively, the overlap of color-based pattern portions may be determined by identifying a sewing region from an imaginary line connecting coordinate points of one color-based pattern portion and detecting coordinate points of another color-based pattern portion within the identified sewing region.

The control device 21 generates a contrasting density level table to determine a contrasting density level LV based on the color saturation S. The contrasting density level table is set so that the number of divisions of contrasting density level LV corresponds with the maximum number c of overlaps of the color-based pattern portions (see FIG. 12), for example, as shown in FIG. 9. Accordingly, the color saturation S in the contrasting density level table is represented by a unit saturation $U_C$ obtained by dividing the color saturation S by the maximum number c of overlaps. As a result, contrasting density level LV1 is set to a range in which color saturation S is larger than 0% and is equal to or smaller than $U_C$ %. Contrasting density level LV2 is set to a range in which color saturation S is larger than $U_C$% and is equal to or smaller than $2U_C$ %. Thus, contrasting density $LV_C$ is set to a range in which color saturation S is larger than $(c-1)\,U_C$% and is equal to or smaller than 100%. In the example, the contrasting density level LV of an achromatic color (white, black and gray) having 0% color saturation S is determined based on a color value V. For example, white is classified into the contrasting density level LV1 and black is classified into the contrasting density level LVc. The contrasting density level should not be limited to the classification based on the color saturation. The color value may be set by the use of RGB values.

The control device 21 is configured to classify RGB values of 64 or 300 colors corresponding to the first or second pallet table, into the groups LV1 to LVc for every contrasting density level thereby to store the classified RGB values into the contrasting-density-based buffer (the color information storage area 246 of the RAM 24). In this case, the RGB values of a plurality of colors belonging to the groups are stored together with contrasting density-based color numbers corresponding to the respective RGB values. The control device 21 thus serves as a first allocation unit which allocates the colors of the first or second pallet table to the plural groups according to the number of overlaps on the basis of color contrasting density.

The control device 21 further serves as a random number generation unit which generates a random number by the use of a function with the maximum value of contrasting-density-based color number as an argument. The control device 21 is configured to randomly extract a color to be used as thread color data for every color-based pattern portion from the colors belonging to the corresponding contrasting density level LV by using a random number and to assign the extracted color to the corresponding color-based pattern portion.

The operation of the embroidery data processing program will now be described with special attention to the coloration of thread color data with reference to FIGS. 10A and 10B, which are flowcharts showing processing procedure executed by the control device 21 based on the embroidery data processing program.

When the user touches the touch panel 9*a*, the control device 21 reads the embroidery data from the ROM 23 and controls the display 9 so that a pattern selecting screen (not shown) is displayed according to the embroidery data. A desired embroidery pattern is selected from a plurality of embroidery patterns on the embroidery pattern screen by a touch operation. The control device 21 changes the display 9 from a menu screen for generation of embroidery data of the selected embroidery pattern to the first color change screen 101 as shown in FIG. 5, thereby executing an initial setting process for execution of coloration of the embroidery pattern. When a pallet selecting key 54*b* is selected on the first color change screen 101, the control device 21 changes the display 9 from the first color change screen 101 to the second color change screen. As a result, the pallet to be used for random coloration can be changed from a first color pallet 53 to a second color pallet. Furthermore, when the SHUFFLE key 55 is touched, the control device 21 changes the display 9 from the first color change screen 101 or the second color change screen to a color tone setting screen 102.

Figures 11, 12:
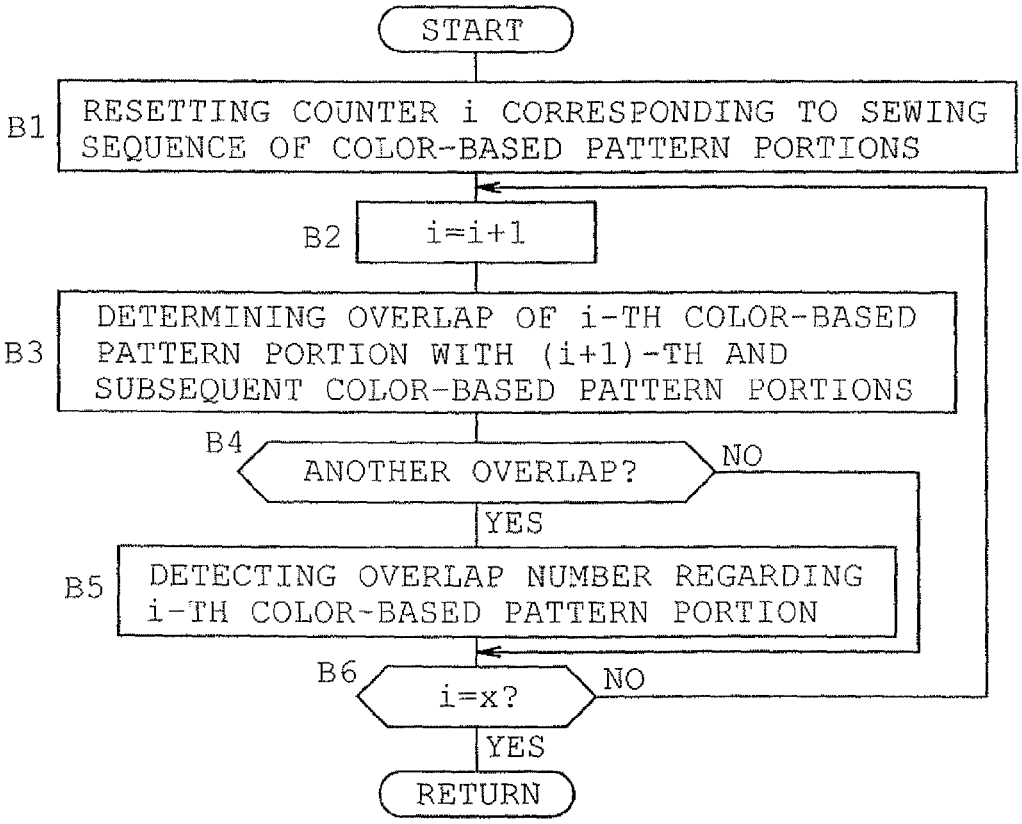
FIG. 11 is a flowchart showing determination as to overlap and an overlap number detecting process.
FIG. 12 shows an overlap sequence of the color-based pattern portions.

When a RANDOM key 58*a* is touched on the color tone setting screen 102, the control device 21 refers to the selected embroidery data to obtain a total number x of the color-based pattern portions (step A2), proceeding to an overlap determination and overlap number detecting process (step A3; and see FIG. 11). More specifically, the control device 21 resets a counter i to 0 at step B2 and increments the counter i by 1 at step B2. The counter i corresponds to the sewing sequence of the color-based pattern portions. The control device 21 then determines whether or not a first color-based pattern portion in the sewing sequence overlaps with second and subsequent color-based pattern portions at least partially (step B3). When detecting no overlap between the first color-based pattern portion and the other color-based pattern portions (NO at step B4 and NO at step B6), the control device 21 updates the counter into (i+1) (step B2), sequentially determining occurrence of overlap regarding the second or subsequent color-based pattern portions (steps B3 and B4). Furthermore, when determining at step B4 that overlap between the color-based pattern portions is present (YES), the control device 21 detects the number of color-based pattern portions as the overlap number (step B5).

In the case of the aforesaid embroidery pattern 40, the first color-based pattern portion 401 to be sewn first overlaps with all of the other color-based pattern portions 402 to 404. Accordingly, the control device 21 obtains the number of all the overlaps in the embroidery pattern 40 at step B5 where detection is carried out regarding the first color-based pattern portion.

In the following, the process of determining occurrence of overlap and detecting the number of overlaps with respect to the first color-based pattern portion (steps B3 and B5) will be described with reference to FIG. 8. At step B3, the control device 21 refers to the needle location data regarding the first color-based pattern portion 401 to extract line segment data of the imaginary line OL1 connecting four corner coordinate points $P_0$ to $P_3$ of the together by straight lines. In the same manner, the control device 21 refers to the needle location data of the second color-based pattern portion 402 to extract line segment data of the imaginary line OL2. The control device 21 then determines occurrence of intersection of both imaginary lines OL1 and OL2, based on the line segment data of the first and second color-based pattern portions 401 and 402. Furthermore, the control device 21 sequentially refers to needle location data to extract line segment data regarding the other color-based pattern portions 403 and 404, thereby determining occurrence of intersection of the imaginary line OL1 of the first color-based pattern portion 401 and the imaginary line OL3 or OL4 of the other color-based pattern portion 403 or 404.

The imaginary line OL1 of the first color-based pattern portion 401 intersects with the other imaginary lines OL2 to OL4 of the other color-based pattern portions 402 to 404 as shown in FIG. 8. As a result, overlaps of the first color-based pattern portion 401 with the other color-based pattern portions 402 to 404 are recognized (YES at step B4). The control device 21 then proceeds to step B5 to compute coordinate values of intersections $Q_0$ and $Q_1$ of the imaginary lines OL1 and OL2 of the overlapping color-based pattern portions 401 and 402, thereby extracting line segment data of an imaginary line connecting the coordinate points $Q_0$, $Q_1$ and $P_3$ by straight lines regarding an overlapping portion E1 as shown by hatched lines in FIG. 8. In the same manner, the control device 21 computes coordinate values of intersections Q2 and Q3 of imaginary lines OL1 and OL3 regarding an overlapping portion E2 of the first and third color-based pattern portions 401 and 403, thereby extracting line segment data of an imaginary line connecting the coordinate points $Q_2$ and $P_1$, an imaginary line connecting the coordinate points $P_1$ and $Q_3$ and an imaginary line OL3 connecting the coordinate points $Q_2$ and $Q_3$. The control device 21 further computes coordinate values of intersections of the imaginary lines OL1 and OL4 regarding the overlapping portion E3 of the first and fourth color-based pattern portions 401 and 404, extracting line segment data of an imaginary line connecting the coordinate points Q4, Q5 and P2 by straight lines.

The control device 21 then determines occurrence of intersections of the imaginary lines based on the line segment data of the overlapping portions E1 to E3, thereby detecting overlaps of the overlapping portions E1 to E3, that is, the number of overlaps in the first color-based pattern portion 401. In this case, since intersection occurs only between the overlapping portions E1 and E3, the number of the color-based pattern portions 401, 402 and 403 composing the overlapping portions E1 and E3 (that is, 3) is obtained as the number of overlaps. Furthermore, since the overlapping portion E2 does not overlap the other overlapping portions E1 and E3, the number of overlaps becomes 2 from the number of the color-based pattern portions 401 and 403 composing the overlapping portion E2. Thus, the numbers of overlaps in the respective color-based pattern portions 401 to 404 are sequentially detected by execution of steps B2 to B5. When determining that the value of the counter is equal to the total number of color-based pattern portions (YES at step B6), the control device 21 returns to step A4 in FIG. 10A.

The control device 21 obtains a unit color saturation $U_C$ by dividing the color saturation S by the maximum c of the number of detected overlaps (3 in the embroidery pattern 40) at step A4. Consequently, a contrasting density level table is generated which is divided by a predetermined unit saturation $U_C$ (density unit) so that the contrasting density level corresponds with the maximum c of the detected number of overlaps, and a color coding process is executed. For example, in the contrasting density level table as shown in FIG. 9, the unit color saturation $U_C$ is set at 33.3% since the color saturation S is divided into 3 the number of which corresponds with the maximum c of the detected number of overlaps. Furthermore, in the color coding process, the control device 21 reads RGB values corresponding to the pallet-based color number 1 of the first pallet table when the pallet selected in the initial setting process is the first color pallet 53. The control device 21 then computes a color saturation S based on the read RGB values and checks the contrasting density level table. As a result, the color of the pallet-based color number 1 is stored in the color information storage area 246 as the color of the new contrasting-density-based color number 1 in the corresponding contrasting density level LV. Regarding colors of pallet-based color number 2 and subsequent numbers, RGB values are also read and new contrasting density-based color numbers are given to the corresponding contrasting density levels to be stored on the contrasting-density-based buffer. Thus, new contrasting density-based color numbers are given to corresponding 64 colors of the first color pallet 53 for every one of groups of contrasting density levels LV1 to LVc respectively, to be stored on the contrasting-density-based buffer.

When the second color pallet has been set as a pallet to be used for coloration at step A1, the same processing as applied to the first color pallet 53 is carried out at step A4 regarding the second color pallet. More specifically, when the display 9 is changed from the second color change screen to the color tone setting screen 102, the control device 22 stores on the contrasting-density-based buffer RGB values collated to 300 colors of the second color pallet for every group of contrasting density levels LV1 to LVc and contrasting density-based color numbers corresponding to the respective RGB values.

The control device 22 then sets an overlap sequence of the color-based pattern portions 401 to 404, based on the number of overlaps detected at step A3 and the sewing sequence of the color-based pattern portions 401 to 404 (step A5). More specifically, the color-based pattern portions 401, 402 and 404 forming three overlaps in the embroidery pattern 40 are set so as to overlap in the sewing sequence, that is, from the lower side as the overlap sequence (see FIGS. 8 and 12). The remaining third color-based pattern portion 403 overlaps with the color-based pattern portion 401. Since the number of overlaps is 2 in this case, the overlap sequence is set to 2 according to the sewing sequence.

However, the third color-based pattern portion 403 does not overlap with the fourth color-based pattern portion 404 that is located slightly over the third color-based pattern portion 403 and has a later turn in the sewing sequence. Accordingly, the only requirement is that the third color-based pattern portion 403 is darker than the lower color-based pattern portion 401. Furthermore, any color-based pattern portion that does not overlap with the other color-based pattern portions can be set to any one of contrasting density levels LV1 to LVc. Accordingly, the overlap sequence is re-set regarding the color-based pattern portion 403 (step A7) when the color-based pattern portion 403 is not included in the color-based pattern portions 401, 402 and 404 having a largest overlap number c and when another color-based pattern portion does not overlap with an upper side of the color-based pattern portion 403 (YES at step A6). In this case, a random overlap sequence can be set when a random number that is within the largest overlap number c and is larger than an overlap sequence of the lower color-based pattern portions. Consequently, the overlap sequence of the third color-based pattern portion 403 is re-set at 2 or 3 (see FIG. 12), and the color-based pattern portion that has no overlap is set to any one of 1, 2, 3 and c. Additionally, at steps A5 to A7, any color-based pattern portion overlapping with another or other color-based pattern portions and having an earlier sewing sequence is set to a relatively smaller overlap number, while any color-based pattern portion overlapping with another or other color-based pattern portions and having a later sewing sequence is set to a relatively larger overlap number.

The control device 21 then resets the sewing sequence counter i to 0 (step A8), executing an assignment process of randomly coloring every color-based pattern portion, based on the above-described overlap sequence and the data of the contrasting-density-based buffer (steps A9 et al.). In the assignment process, the control device 21 firstly increments the counter i by 1 at step A9 and determines whether or not the first color-based pattern portion 401 whose sewing sequence i is 1 has the overlap sequence of 1 (step A10). When determining that the color-based pattern portion 401 has the overlap sequence of 1 (YES at step A10), the control device 21 refers to the contrasting-density-based buffer of the RAM 24 to generate a random number within the range of the total number of colors belonging to the contrasting density level LV1 (step A13). For example, when the total number of colors or the maximum contrasting-density-based color number is 20, a random number within a range of 1 to 20 is generated. The control device 21 then checks the contrasting-density-based color number corresponding with the random number generated at contrasting density level LV1, extracting a color of the corresponding contrasting-density-based color number (RGB values).

Consequently, the control device 21 randomly extracts a color to be used as thread color data from the colors belonging to a darkest contrasting density level LV1, with respect to the first color-based pattern portion 401 with the overlap sequence of 1. Furthermore, data of the extracted color is stored on the extracted data storage area 249 of the RAM 24 as the color to be assigned to the first color-based pattern portion 401 (step A16).

When the extracted color is stored in the extracted data storage area 249, the control device 21 updates the counter i to i=i+1 (step A9) to execute the assignment process fro the second and subsequent color-based pattern portions (NO at step A17). The control device 21 determines whether or not the overlap sequence of the second color-based pattern portion 402 is 1. When determining that the overlap sequence is not 1 (NO at step A10), the control device 21 determines whether or not the overlap sequence is 2 (step A11). Regarding extraction of the second to subsequent color-based pattern portions, the control device 21 thus determines to what of 1 to maximum c the overlap sequences of the color-based pattern portions correspond (steps A10 to A12), thereby randomly extracting colors from the colors of contrasting density level LV according to the respective overlap sequences (steps A13 to A15). In the example, regarding the color-based pattern portion having the overlap sequence c, one of colors is randomly extracted from the highest level LVc group as shown in steps A12 to A15. On the other hand, regarding the color-based pattern portion having the overlap sequence of 1 such as the first color-based pattern portion 401, one of colors is randomly extracted from the lowest level LV1 group.

Furthermore, the control device 21 executes any one of the aforesaid steps A13, A14, . . . and A15 according to the overlap sequence, whereby the colors having different contrasting density levels LV and not overlapping can be extracted regarding the overlapping color-based pattern portions 401, 402 and 404 or color-based pattern portions 401 and 403. Data of the extracted color is stored and the counter i is incremented every time of color extraction (step A16, NO at step A17, and step A9). The assignment process (steps A9 to A17) is repeatedly executed until it is determined that the value of counter i equals x (YES at step A17). The control device 21 stores data of the colors assigned in the assignment process in the extracted data storage area 249 so that the colors correspond to the respective color-based pattern portions 401 to 404, ending the assignment process or returning.

Subsequently, the embroidery pattern 40 is displayed on the enlarged display screen 103 with the colors assigned to the respective color-based pattern portions. In the embroidery pattern, a relatively lighter color is assigned through the above-described assignment process to the color-based pattern portion to be sewn relatively earlier in the sewing sequence of the four color-based pattern portions 401 to 404 (see reference numeral 401 in FIG. 7), and a relatively darker color is assigned to the color-based pattern portion to be sewn relatively later in the sewing sequence (see reference symbol 404 in FIG. 7).

When the set key 67 is touched on the enlarged display screen 103, the embroidery data of the embroidery pattern is stored on the EEPROM 25, and the display 9 is returned to the first color change screen 101. On the other hand, when the close key 66 is touched, the display 9 is returned to the color tone setting screen 102. As a result, the control device 21 can execute the random coloration process again.

The control device 21 serves as the assignment unit to randomly extract the colors to be used as the thread color data and to execute an assignment routine of assigning the extracted colors to the respective color-based pattern portions, at steps A9 to A17. The control device 21 also serves as the overlap determination unit to execute an overlap determination routine of determining whether or not two or more of the color-based pattern portions overlap with each other at least partially, based on the embroidery data, at step A3 (particularly at steps B3 and B4). The control device 21 further serves as the overlap number detection unit to execute an overlap number detection routine of detecting the number of overlaps in the case where two or more of the color-based pattern portions overlap at least partially, at steps B4 and B5.

In the embroidery data generating device 30, the control device 21 is thus capable of assigning the extracted colors to the respective thread color data of the color-based pattern portions composing the embroidery pattern thereby to be capable of executing random coloration. Accordingly, the coloration of the embroidery pattern can easily be carried out while troublesome works including confirmation and designation of thread color data are eliminated. Furthermore, the embroidery data is generated in which the contrasting density sequence of the colors assigned to the respective color-based pattern portions corresponds to the sewing sequence of the color-based pattern portions. Accordingly, when the order of the contrasting density is caused to correspond to the sewing sequence so that the color-based pattern portion to be sewn relatively later in the sewing sequence becomes darker, an embroidery thread of the lower color-based pattern portion to be sewn earlier can be prevented from being visible through an embroidery thread of the upper color-based pattern portion to be sewn later. Consequently, various coloration patterns can efficiently be obtained while the embroidery pattern ensures a predetermined level of quality.

The control device 21 is configured, in the assignment routine, to assign colors to the respective color-based pattern portions so that the sewing sequence corresponds to the contrasting density sequence of the colors, based on the sewing sequence of the color-based pattern portions. According to this configuration, the assignment of the colors to the respective color-based pattern portions can precisely be executed without change in the predetermined sewing sequence of the color-based pattern portions.

The control device 21 is also configured to assign a relatively lighter color to the color-based pattern portion to be sewn relatively earlier in the sewing sequence regarding overlapping color-based pattern portions and to assign a relatively darker color to the color-based pattern portion to be sewn relatively later in the sewing sequence, based on the result of determination in the overlap determination routine and the sewing sequence. Accordingly, embroidery data is generated so that the darker color-based pattern portion overlaps with an upper side of the lighter color-based pattern portion, with the result that the embroidery pattern can ensure a predetermined level of quality.

The control device 21 is further configured to assign a relatively lighter color to a color-based pattern portion to be sewn relatively earlier in the sewing sequence and a relatively darker color to a color-based pattern portion to be sewn relatively later in the sewing sequence, based on the overlap number detected in the overlap number detection routine and the sewing sequence. Accordingly, the darker color-based pattern portion overlaps with an upper side of the lighter color-based pattern portion irrespective of the number of the overlapping color-based pattern portions, whereupon the coloration resulting in good-looking embroidery pattern can be carried out.

The control device 21 still further configured to execute a first allocation routine of allocating a plurality of colors stored on the color data storage unit to a plurality of groups according to the number of overlaps, based on contrasting densities of the colors (step A4). The control device 21 then causes the order of contrasting density of the colors and the sewing sequence to correspond to each other among the groups (LV1 to LVc) allocated in the first allocation routine thereby to randomly extract colors from the groups corresponding to the respective color-based pattern portions. Accordingly, a relatively lighter color is assigned to a lower located color-based pattern portion to be sewn relatively earlier in the sewing sequence, and a color that becomes darker stepwise according to the number of overlaps is assigned to an upper located color-based pattern portion to be sewn relatively later in the sewing sequence. This can easily achieve a color tone showing gradation according to the number of overlaps of the color-based pattern portions while a random coloration is employed for the embroidery pattern.

In the foregoing example, the maximum c of the number of overlaps corresponds with the number of groups (LV1 to LVc) to which colors are allocated respectively, and the colors are extracted from different groups so as to correspond to the number of overlaps. Consequently, the colors belonging to the respective groups can evenly be assigned to the overlapping color-based pattern portions. This can ensure execution of a suitable assignment process with use of all the groups of colors (contrasting density levels).

The embroidery pattern is displayed on the display 9 serving as a display unit with the use of the colors assigned to the thread color data of the color-based pattern portions. Consequently, the colors of the respective color-based pattern portions of the generated embroidery data can easily be grasped visually.

SECOND EXAMPLE

FIGS. 13 and 14 illustrate a second example. Only the differences between the first and second examples will be described below.

In a contrasting density level table employed in the second example, the number of divisions of contrasting density level LV is set so as to correspond with the total number x of the color-based pattern portions as shown in FIG. 13. Accordingly, the color saturation S in the contrasting density level table is represented by the unit color saturation $U_X$ obtained by dividing the color saturation S by total number x of the color-based pattern portions. As a result, the color saturation S is divided into unit color saturations which are a range of 0 to $U_X$, a range of $U_X$ to $2U_X$, . . . , a range of (i−1) $U_X$ to i $U_X$, . . . , and a range of (x−1) $U_X$ to 100%. The unit color saturations correspond to contrasting density levels LV1, LV2, . . . , LVi, . . . , and LVx respectively in FIG. 13.

Figure 10A:
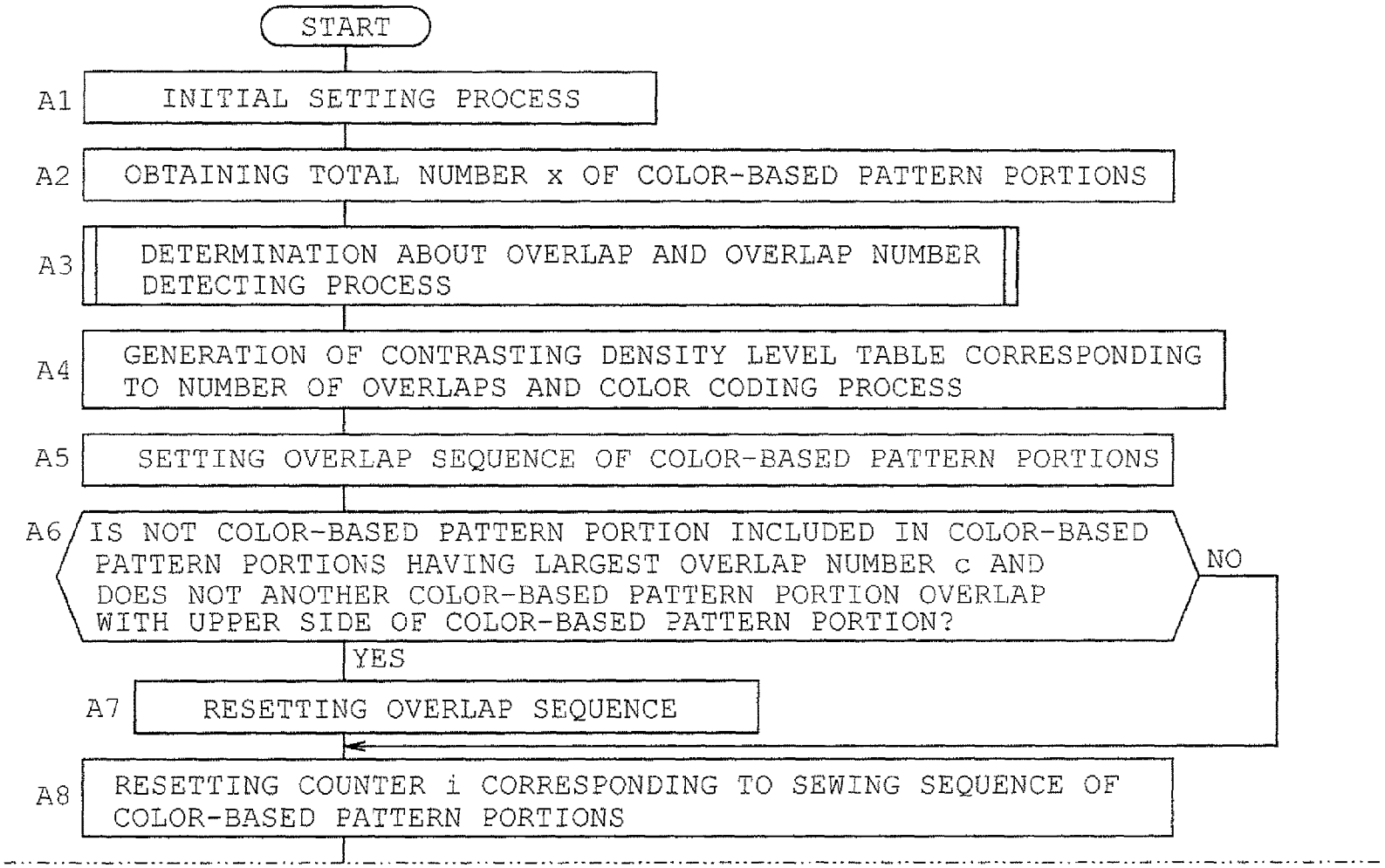
FIGS. 10A and 10B are flowcharts showing thread color data setting in an embroidery data generating proves.
Figure 10B:
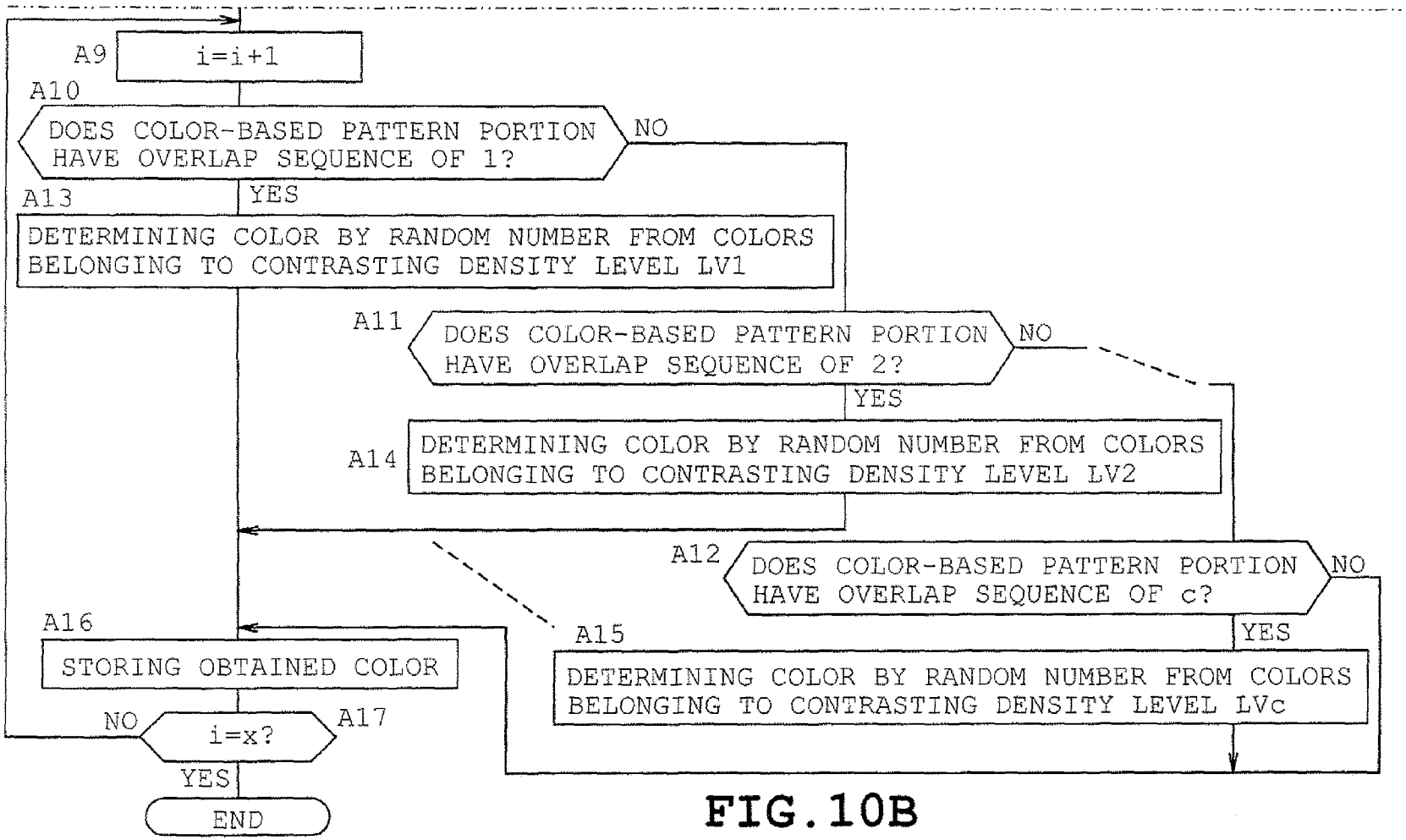
Figure 14A:
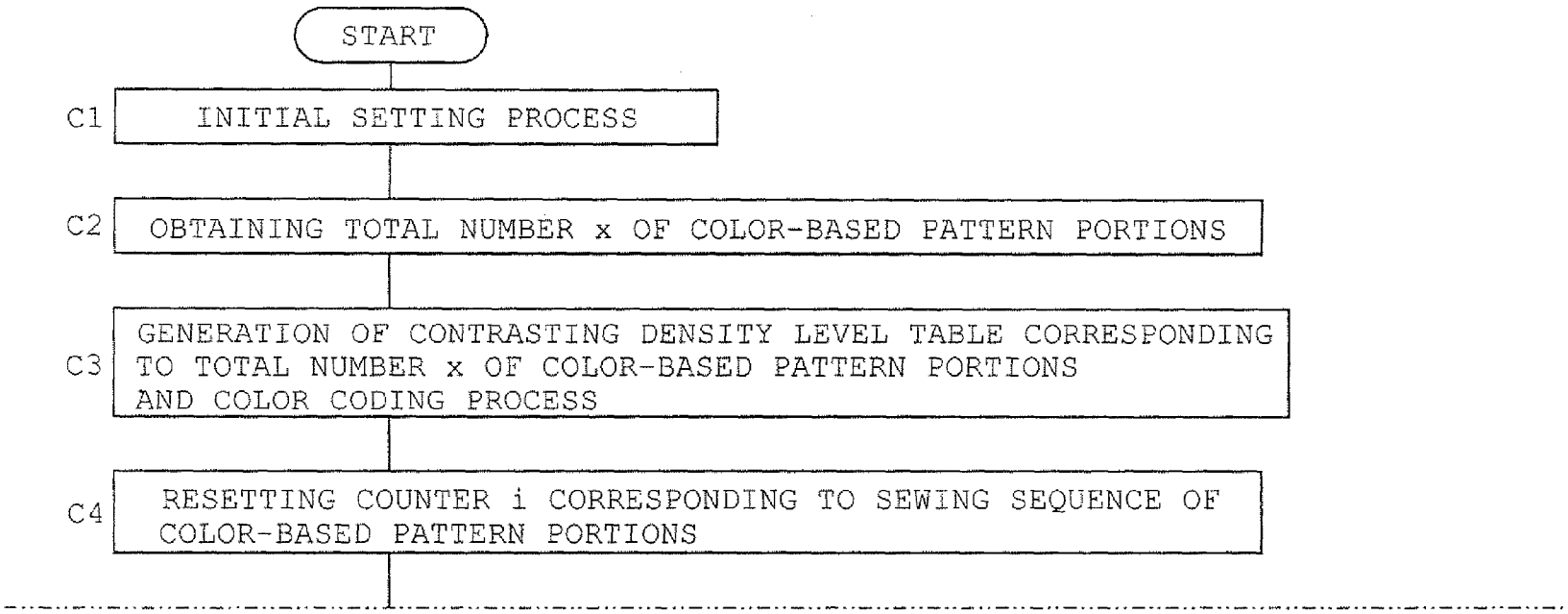
FIGS. 14A and 14B are flowcharts similar to FIGS. 10A and 10B.
Figure 14B:
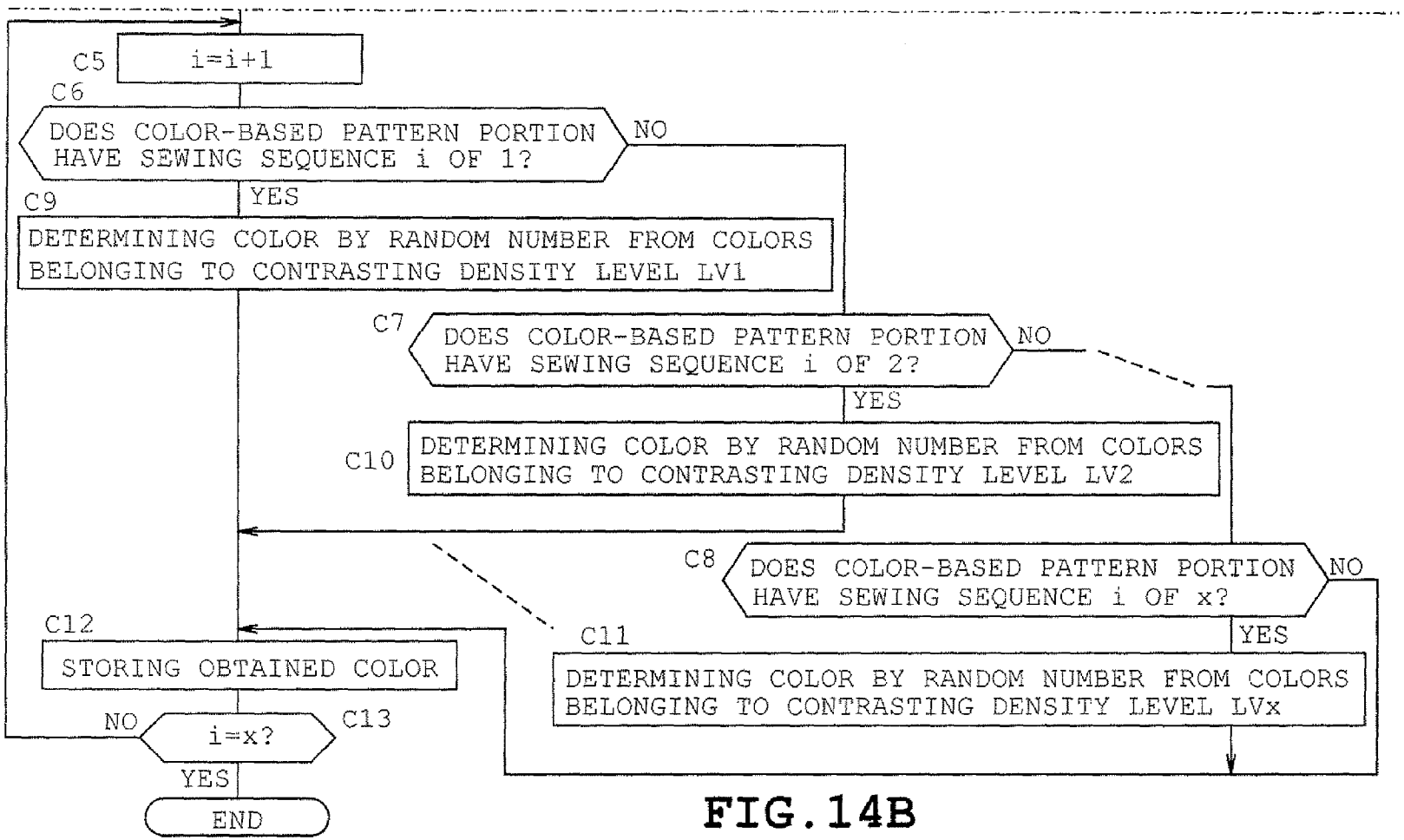

The following describes a process of generating the contrasting density level table and an assignment process based on the generated contrasting density level table with reference to FIGS. 14A and 14B, which are flowcharts showing a processing procedure and corresponding to FIGS. 10A and 10B in the first example. Firstly, in an initial setting process at step C1, the first color pallet 53 or the second color pallet is set as a pallet to be used for random coloration in the same manner as in the first example. Subsequently, when the RANDOM key 58*a* on the color tone setting screen 102 is touched, the control device 21 refers to the selected embroidery data to obtain the total number x of color-based pattern portions (step C2). The control device 21 divides color saturation S by the total number x of color-based pattern portions to obtain a unit saturation $U_X$, thereby generating a contrasting density level table which is divided into predetermined unit saturations $U_X$ (unit density) so that the number of contrasting density levels corresponds with the total number x of color-based pattern portions. The control device 21 further executes a color coding process (step C3; and also see FIG. 13).

For example, the embroidery pattern 40 is composed of four color-based pattern portions 401 to 404 (total number x=4). Accordingly, in the contrasting density table of FIG. 13, the color saturation S is divided into four ranges the number of which corresponds with the total number x, whereby each unit color saturation $U_X$ is set at 25%. Furthermore, in the color coding process, 64 colors of the first color pallet 53 or 300 colors of the second color pallet are allocated to the contrasting density levels LV1 to LV4. In this case, the control device 21 stores, in the contrasting-density-based buffer, RGB values of the colors of the first or second color pallet allocated to the four contrasting density levels the number of which corresponds with the total number x and contrasting density-based color numbers corresponding to the RGB values for every contrasting density level LV.

The control device 21 then resets to 0 the counter i corresponding to the sewing sequence of the color-based pattern portions (step C4), executing an assignment process in which a random color scheme is carried out for each color-based pattern portion, based on the data in the contrasting-density-based buffer and the sewing sequence (steps C5 ect.). In the assignment process, the control device 21 firstly increments the counter i by 1 at step C5 and then determines whether or not the sewing sequence i indicates the first color-based pattern portion 401 (step C6). When determining that the sewing sequence indicates the first color-based pattern portion 401 (YES), the control device 21 refers to the contrasting-density-based buffer of the RAM 24 to generate a random number within a range of total number of colors belonging to the contrasting density level LV1 (step C9). The control device 21 further checks the contrasting density-based color number corresponding with the random number generated at contrasting density level LV1 to extract a color of the corresponding contrasting density-based color number. As a result, the control device 21 randomly extracts the color belonging to the lightest contrasting density level LV1 for the first color-based pattern portion 401 with the first turn in the sewing sequence, that is, the color with color saturation S larger than 0% and equal to or smaller than 25%. The initially extracted color is stored in the extracted data storage area 249 of the RAM 24 as the color to be assigned to the first color-based pattern portion 401 (step C12).

When storing the extracted color in the extracted data storage area 249, the control device 21 updates the counter i to i=i+1 (step C5) in order to execute an assignment process for the second color-based pattern portion 402 (NO at step C13). The control device 21 randomly extracts a color from the group of the second lighter contrasting density level LV2 (step C10) for the second color-based pattern portion 402 to be sewn second in the sewing sequence i (NO at step C6 and YES at step C7). The extracted color is stored in the extracted data storage area 249 so as to correspond to the second color-based pattern portion 402, and the counter i is incremented by 1 (step C12, NO at step C13, and step C5).

Thus, in the second example, steps C6 and C9, steps C7 and C10, . . . and so on are executed in the order of the color-based pattern portion to be sewn relatively earlier in the sewing sequence, and steps C8 and C11 are executed last. At steps C8 and C11, the control device 21 randomly extracts a color from the group of the darkest contrasting density level LV4 for the fourth color-based pattern portion 404 which is to be sewn last in the sewing sequence. As a result, the colors assigned in the assignment process are stored in the extracted data storage area 249 so as to correspond to the respective color-based pattern portions 401 to 404 without any reduplication. When determining that the value of the counter i is equal to x (YES at step C13), the control device 21 ends the assignment process.

As understood from the foregoing, the control device 21 in the second example serves as a second allocation unit which executes a second allocation routine of allocating a plurality of colors to a plurality of groups (LV1 to LVx) the number of which corresponds to the total number x of color-based pattern portions by contrasting density (step C3). Furthermore, in the assignment process, the color is randomly extracted from a group of relatively lighter colors (LV1, for example) in the groups (LV1 to LVx) for the color-based pattern portion as the color-based pattern portion is to be sewn relatively earlier in the sewing sequence, and the color is randomly extracted from a group of relatively darker colors (LVx, for example) in the groups (LV1 to LVx) as the color-based pattern portion is to be sewn relatively later in the sewing sequence. This can easily achieve a color tone showing gradation according to the number of overlaps of the color-based pattern portions while a random coloration is employed for the embroidery pattern.

In the second example, the total number x of color-based pattern portions corresponds with the number of groups (LV1 to LVx) from one of which a color is extracted, and the colors are extracted from different groups. Consequently, the colors belonging to the respective groups can evenly be assigned to the color-based pattern portions. This can ensure execution of a suitable assignment process with use of all the groups of colors (contrasting density levels).

THIRD EXAMPLE

Figure 15:
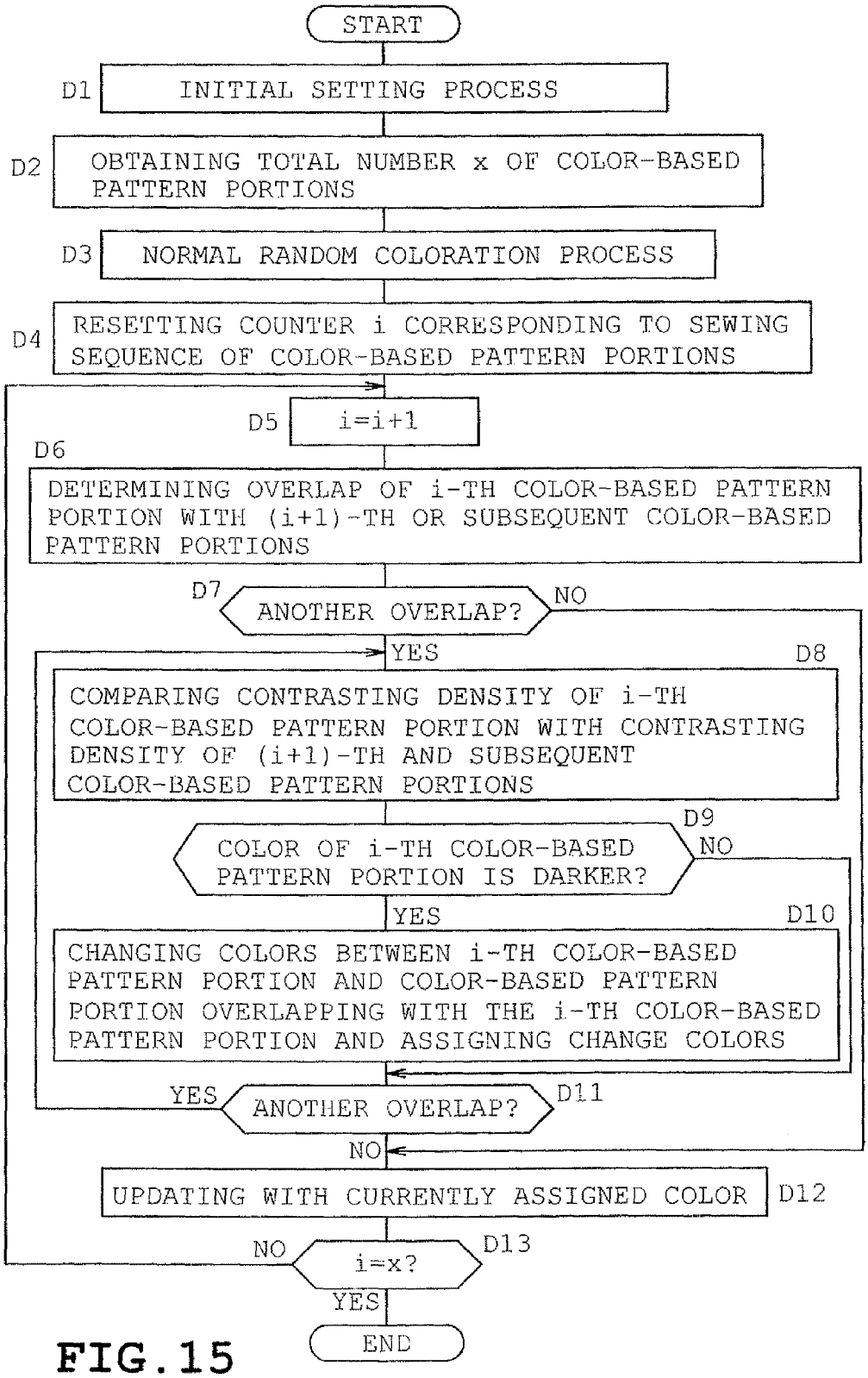
FIG. 15 is a flowchart similar to FIGS. 10A and 10B, showing a third example.

FIG. 15 illustrates a third example. Only the differences between the first and third examples will be described below. FIG. 15 is a flowchart showing a processing procedure and corresponding to FIGS. 10A and 10B in the first example.

Firstly, in the initial setting process at step D1, the user sets the first or second color pallet as the pallet to be used for random coloration. When the user touches the RANDOM key 58*a* on the color tone setting screen 102, the control device 21 refers to the selected embroidery data to obtain the total number x of color-based pattern portions (step D2).

At step D3, the control device 21 executes a normal random coloration process without generating the aforesaid contrasting density level table. More specifically, in the random coloration process, when the first color pallet 53 has been set at step D1, the control device 21 generates a random number ranging in the total number of colors of the first pallet table 53, that is, a random number ranging from 1 to 64. The control device 21 then checks one of the pallet-based color numbers 1 to 64 of the first pallet table, which one corresponds with the generated random number. The control device 21 extracts a color corresponding to the relevant pallet-based color number, storing the extracted color in the extracted data storage area 249 of the RAM 24 as the color to be assigned to the first color-based pattern portion 401. The control device 21 extracts second and subsequent colors using the random numbers, whereby the same number of colors as the total number x of color-based pattern portions are stored in the storage area 249. As a result, four randomly extracted colors are stored in the storage area 249 in corresponding relationship with the respective color-based pattern portions 401 to 404 at step D3. Accordingly, the assignment process for random coloration is executed without consideration of color contrasting density at step D3.

The control device 21 resets the sewing sequence counter i to 0 (step D4) and executes a process of rearranging the colors in the order of contrasting density according to the sewing sequence for every color-based pattern portion (steps D5 etc.).

More specifically, when incrementing the counter i by 1 at step D5 and determining whether or not the first color-based pattern portion 401 which is the first in the sewing sequence i overlaps at least partially with the (i+1)-th or subsequent color-based pattern portions 402 to 404 (step D6). In the determination of overlap, occurrence of intersection of the imaginary line OL1 of the first color-based pattern portion 401 and the other imaginary lines OL2 to OL4 is detected based on the line segment data of the first to fourth color-based pattern portions 401 to 404 in the same manner as at step B3 in FIG. 11. When overlap is found on the first color-based pattern portion 401 (YES at step D7), the contrasting density of the first color-based pattern portion 401 is compared with the contrasting density of the second color-based pattern portion 402 to be sewn relatively earlier in the sewing sequence (step D8). In this case, the control device 21 reads the RGB values of the colors assigned to the respective first and second color-based pattern portions 401 and 402 at step D3. The control device 21 computes color saturations S based on the read RGB values to compare the color saturations S with each other. When determining that the color of the first color-based pattern portion 401 is darker (YES at step D9), the colors of the first and second color-based pattern portions 401 and 402 are assigned so as to be interchanged (step D10).

As a result, when the lighter color than the color of the second color-based pattern portion 402 is assigned to the first color-based pattern portion 401 or when the lighter color than that of the second color-based pattern portion 402 has been assigned to the first color-based pattern portion 401 at step D3 (NO at step D9), the control device 21 determines occurrence of overlap between the first color-based pattern portion 401 and the other color-based pattern portions 403 and 404 (step D11). In this case, since the third color-based portion 403 partially overlaps with the first color-based pattern portion 401 (YES), the contrasting densities of the first and third color-based pattern portions 401 and 403 are compared with each other (step D8). The control device 21 obtains color saturations S of both color-based pattern portions 401 and 403 from the RGB values to compare the saturations S with each other. When determining that the first color-based pattern portion 401 has a darker color than the third color-based pattern portion 403 (YES at step D9), the control device 21 assigns the colors to the respective first and third color-based pattern portions 401 and 403 so that the colors are interchanged (step D10). Thus, when the first color-based pattern portion 401 overlaps with each one of the second to fourth color-based pattern portions 402 to 404 (YES at step D7), the control device 21 repeatedly executes steps D8 to D11, whereupon the lighter color than those of the other color-based pattern portions 402 to 404 is assigned to the first color-based pattern portion 401.

The color of the first color-based pattern portion 401 stored in the extracted data storage area 249 is updated to the one assigned to the first color-based pattern portion 401 (step D12) after the overlap of the first color-based pattern portion 401 and each of the other color-based pattern portions 402 to 404 has been determined, that is, at the time the control device 21 determines in the negative at step Dli or step D7.

The control device 21 increments the counter i by 1 (step D5) to apply the same process as described above to the second color-based pattern portion 402 (NO at step D13). The control device 21 then determines overlap between the second color-based pattern portion 402 and each of the (i+1)-th or subsequent color-based pattern portions 403 and 404 (step D6). When determining that one or both of the third and fourth color-based pattern portions 403 and 404 overlap with the second color-based pattern portion 402 (YES at step D7), the control device 21 sequentially executes steps D8 to D11 regarding either one or both of the third and fourth color-based pattern portions 403 and 404. As a result, a lighter color than those of the third and fourth color-based pattern portions 403 and 404 is assigned to the second color-based pattern portion 402. Color update and increment of the counter i are carried out in the same manner as in the case of the first color. Steps D5 to D13 are repeatedly executed until the control device 21 determines that the value of the counter i equals x (YES at step D13). The color of the fourth color-based pattern portion 404 is determined in relation to the third color-based pattern portion 403 (NO at step D7) since there is no (i+1)-th color-based pattern portion subsequent to the fourth color-based pattern portion 404.

Consequently, the colors of all the color-based pattern portions 401 to 404 stored in the storage area 249 are thus rearranged thereby to be updated so that each color-based pattern portion is rendered relatively darker as it is to be sewn relatively earlier in the sewing sequence, whereby the assignment process is completed.

As understood from the foregoing, the control device 21 in the third example randomly extracts the colors from the first or second pallet table. The number of the colors corresponds with the total number x of the color-based pattern portions. The control device 21 then executes the assignment process of rearranging and assigning the extracted colors in the order of contrasting density according to the sewing sequence (steps D8 to D10). Consequently, the randomness at the time of extraction can be ensured irrespective of the already extracted colors, and the predetermined coloration corresponding to the sewing sequence can be achieved.

FOURTH EXAMPLE

Figure 16:
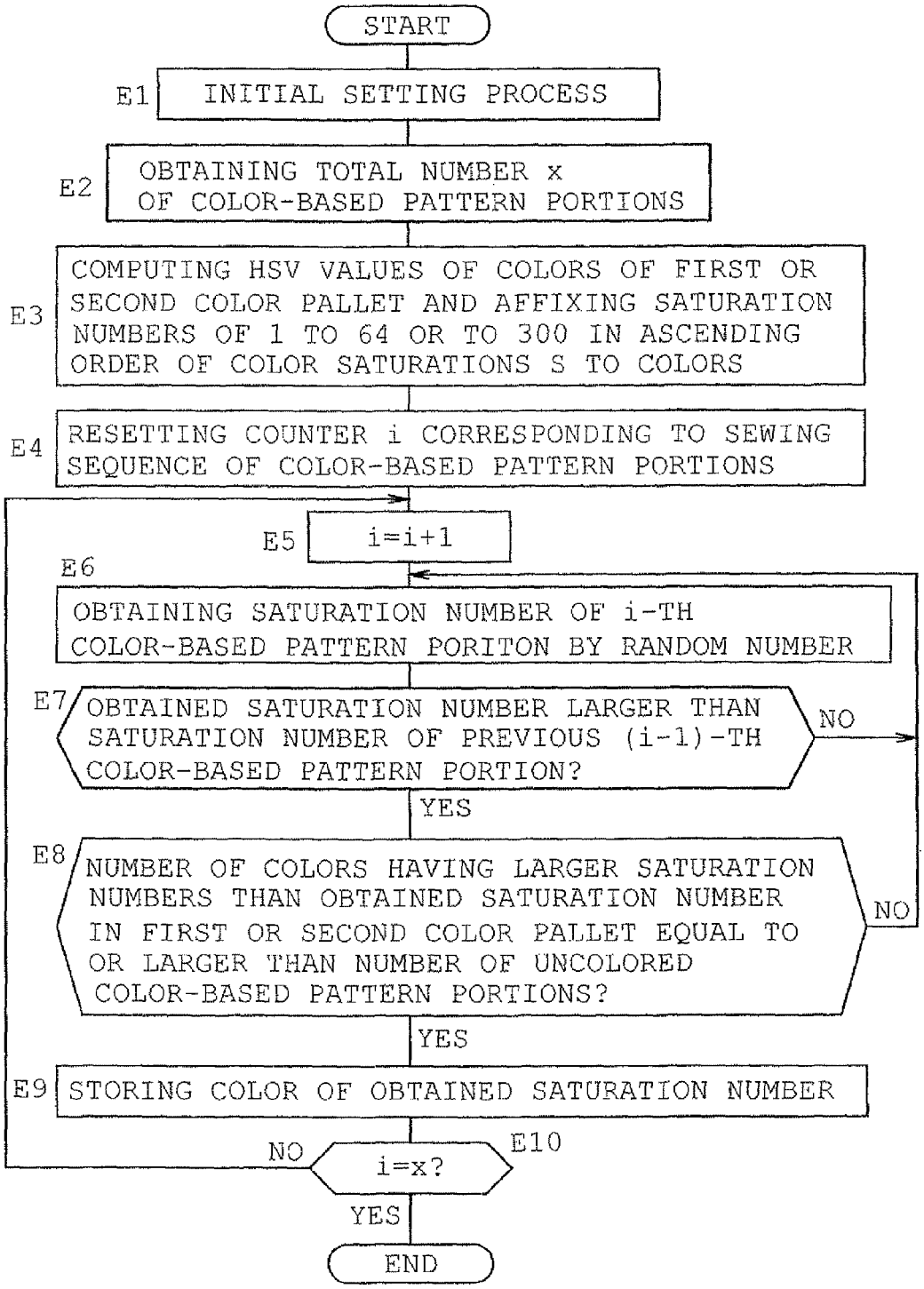
FIG. 16 is a flowchart similar to FIGS. 10A and 10B, showing a fourth example.

FIG. 16 illustrates a fourth example. Only the differences between the first and fourth examples will be described below. FIG. 16 is a flowchart showing a processing procedure and corresponding to FIGS. 10A and 10B in the first example. Firstly, the user sets the first or second color pallet to the pallet to be used for random coloration in the initial setting process (step E1). Furthermore, when the user touches the RANDOM key 58*a* on the color tone setting screen 102, the control device 21 refers to the selected embroidery pattern to obtain the total number x of the color-based pattern portions (step E2). At step E3, the control device 21 carries out a process of rearranging 64 colors of the first color pallet 53 or 300 colors of the second color pallet either which has been set at step E1 so that the colors are arranged in ascending order of the color saturations S. More specifically, when the first color pallet 53 has been selected at step E1, for example, the control device 21 reads the RGB values of 64 colors of the first pallet table 53 to compute the color saturations S. Subsequently, the control device 21 then rearranges the 64 colors in ascending order of the color saturations S based on the computed color saturations S, storing the rearranged contents of the first pallet table in the color information storage area 246. In this case, pallet-based color numbers 1 to 64 corresponding to the color saturations S in the ascending order with respect to the RGB values will be referred to as "saturation number."

The control device 21 subsequently resets to 0 the counter corresponding to the sewing sequence of the embroidery (step E4) and increments the counter i by 1 (step E5). The control device 21 generates a random number within a range (1 to 64) of the maximum saturation number in the color information storage area 246. The control device 21 then obtains the generated random number as the saturation number of the first color-based pattern portion (step E6). The control device 21 then determines whether or not the obtained saturation number of the first color-based pattern portion 401 is larger than the saturation number of the previous (i−1)-th color-based pattern portion, that is, whether or not the color is darker (step E7). In this regard, since there is no color-based pattern portion located before the first color-based pattern portion, the control device 21 determines in the affirmative at step E7. The control device 21 further determines whether or not there are at least three uncolored color-based pattern portions 402 to 404 having respective saturation numbers larger than that obtained in the first pallet group in the color information storage area 246 (step E8). More specifically, when the obtained saturation number of the first color-based pattern portion 401 ranges from 62 to 64 (NO at step E8), colors whose saturation numbers are sequentially increased cannot be assigned to the remaining color-based pattern portions402 to 404 from the first pallet table. In this case, steps E6 to E8 are sequentially repeated. When the saturation number of not more than 61 is obtained (YES at step E8), a color (RGB values) corresponding to the obtained saturation number is stored in the extracted data storage area 249 of the RAM 24 as the color to be assigned to the first color-based pattern portion 401 (step E9).

In order that the same process as applied to the first color-based pattern portion 401 may be executed for the second color-based pattern portion 402, the control device 21 updates the counter i to i=i+1 and generates a random number to obtain a saturation number (steps E5 and E6). The control device 21 repeats the steps E6 and E7 until determining that the saturation number of the second color-based pattern portion 402 is larger than the saturation number of the previous first color-based pattern portion 401 (YES at step E7). Consequently, a color that is darker than the color of the first color-based pattern portion 401 can be extracted for the second color-based pattern portion 402. Furthermore, the control device 21 returns to step E6 when the obtained saturation number of the second color-based pattern portion 402 is 63 or 64 (NO at step E8). On the other hand, when the saturation number is not more than 62, the color is stored in the extracted data storage area 249 as the one to be assigned to the second color-based pattern portion 402 (step E9). The control device 21 repeats steps E5 to E10 until determining that the value of the counter i equals x (YES at step E10). As a result, the obtained colors are stored in the extracted data storage area 249 so as to correspond to the respective color-based pattern portions 401 to 404 in ascending order of the color saturations S, and the process is completed.

As understood from the foregoing, the control device 21 in the fourth example is configured to repeatedly execute the process of randomly extracting the colors to be used as the thread color data (steps E6 to E8) until the colors sequentially become darker than the previously extracted colors. Accordingly, since the extracted colors are assigned to the respective color-based pattern portions in correspondence relationship with the sewing sequence, the predetermined coloration corresponding to the sewing sequence can simply be obtained. The control device 21 is configured to generate embroidery data in which contrasting density levels of the colors assigned to the respective color-based pattern portions correspond to the sewing sequence of the color-based pattern portions. Accordingly, the control device 21 may be configured to repeatedly execute the randomly extracting process until colors sequentially becoming lighter than the previously extracted colors are extracted.

The foregoing examples should not be restrictive but may be modified or expanded as follows. Although the embroidery data generating device is provided on the sewing machine M in the foregoing examples, the embroidery data generating device may be composed of a device body which is a personal computer (or a dedicated machine), a mouse, a keyboard, a memory card connector, a display and the like all of which are connected to the device body.

The color storage unit and the sewing sequence storage unit should not be limited to the RAM 24 and the EEPROM 25 respectively. Other internal storage units built in the sewing machine or the embroidery data generating device may be used, instead. When the sewing machine and the embroidery data generating device are discrete from each other as differing from the foregoing examples, the sewing machine and the embroidery data generating device may be connected to each other by a wired or wireless manner for data communication therebetween.

In the first to fourth examples, the embroidery data is generated in which the order of contrasting density of the colors correspond to the sewing sequence without any change in the sewing sequence. However, the sewing sequence may be changed so as to correspond to the order of color contrasting density. More specifically, the ordinary random coloration process is executed at step D3, and the sewing sequence of the color-based pattern portions is changed based on the color contrasting densities assigned to the respective color-based pattern portions in the coloration process, whereby the embroidery data may be generated in which the order of color contrasting density corresponds to the sewing sequence.

The storage medium storing the embroidery data processing program should not be limited to the ROM 23 of the control device 21. The storage medium may be one of various types of storage media including a CD-ROM, a flexible disc, a DVD and a memory card. In this case, the control device of the embroidery data generating device is configured to read the embroidery data processing program from the storage medium to execute the program, whereupon the same operation and the same effect as those in the foregoing examples can be achieved.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. An embroidery data generating device which generates embroidery data usable to sew by a sewing machine an embroidery pattern composed of a plurality of color-based pattern portions, the device comprising:

a color data storage unit which stores data of a plurality of defined colors;

an assignment unit which randomly extracts colors from the colors stored on the color data storage unit, the extracted colors being used as thread color data for specifying colors of the color-based pattern portions respectively, the assignment unit assigning the extracted colors to the respective color-based pattern portions; and a sewing sequence data storage unit which stores data of a set sewing sequence of the color-based pattern portions, the device generating embroidery data in which an order of contrasting density of the colors assigned to the respective color-based pattern portions by the assignment unit as the thread color data corresponds to a sewing sequence of the color-based pattern portions.

2. The device according to claim 1, wherein the assignment unit assigns the extracted colors to the respective color-based pattern portions so that the order of contrasting density of the colors corresponds to the sewing sequence of the color-based pattern portions, based on the sewing sequence of the color-based pattern portions.

3. The device according to claim 1, wherein the assignment unit repeatedly executes a process of randomly extracting the colors to be used as the thread color data until extracting each extracted color that sequentially becomes darker or lighter than the previously extracted color.

4. The device according to claim 1, wherein the assignment unit executes a process of re-arranging the extracted colors corresponding to a total number of the color-based pattern portions in the order of contrasting density of the extracted colors in accordance with the sewing sequence and assigning the re-arranged colors to the respective color-based pattern portions.

5. The device according to claim 1, further comprising an overlap determination unit which determines whether or not two or more of the color-based pattern portions overlap with each other at least partially, wherein the assignment unit assigns a lighter color to the color-based pattern portion to be sewn relatively earlier in the sewing sequence of the color-based pattern portions and a darker color to the color-based pattern portion to be sewn relatively later in the sewing sequence of the color-based pattern portions, based on a result of determination by the overlap determination unit and the sewing sequence of the color-based pattern portions.

6. The device according to claim 5, further comprising an overlap number detection unit which detects a number of overlaps in a case where two or more of the color-based pattern portions overlap with each other at least partially, based on the result of determination by the overlap determination unit, wherein the assignment unit assigns a lighter color to the color-based pattern portion to be sewn relatively earlier in the sewing sequence of the colored-based pattern portions and a darker color to the color-based pattern portion to be sewn relatively later in the sewing sequence of the color-based pattern portions, based on the number of overlaps detected by the overlap number detection unit and the sewing sequence of the color-based pattern portions.

7. The device according to claim 6, further comprising a first allocation unit which allocates the colors stored on the color data storage unit to a plurality of groups according to the number of overlaps, based on contrasting densities of the colors, wherein the assignment unit randomly extracts colors to be used as thread color data from the groups corresponding to the respective color-based pattern portions, while causing an order of contrasting density of the colors to correspond to the sewing order of the color-based pattern portions, the order of contrasting density being between or among the groups allocated by the first allocation unit, whereby the extracted colors are assigned to the respective color-based pattern portions.

8. The device according to claim 1, further comprising a second allocation unit which allocates the colors stored on the color data storage unit to a plurality of groups according to a total number of the color-based pattern portions, based on contrasting densities of the colors, wherein the assignment unit randomly extracts colors to be used as thread color data from the groups corresponding to the respective color-based pattern portions, while causing an order of contrasting density of the colors to correspond to the sewing sequence, the order of contrasting density being between or among the groups allocated by the second allocation unit, whereby the extracted colors are assigned to the respective color-based pattern portions.

9. A non-transitory computer readable storage medium which is incorporated in an embroidery data generating device including a color data storage unit which stores data of a plurality of defined colors and a sewing sequence data storage unit which stores data of a set sewing sequence of a plurality of color-based pattern portions constituting an embroidery pattern, the non-transitory computer readable storage medium storing an embroidery data processing program used to generate embroidery data to sew the embroidery pattern, the embroidery data processing program comprising:

an assignment routine of randomly extracting colors from the colors stored on the color data storage unit, the extracted colors being used as thread color data for specifying colors of the color-based pattern portions, the assignment routine assigning the extracted colors to the respective color-based pattern portions, wherein the embroidery data processing program is configured so that the embroidery data generating device generates the embroidery data in which an order of contrasting density of the colors to be assigned to the respective color-based pattern portions by the assignment routine as the thread color data corresponds to the sewing sequence of the color-based pattern portions.

10. The medium according to claim 9, wherein the embroidery data processing program is configured so that in the assignment routine, the extracted colors are assigned to the respective color-based pattern portions so that the order of contrasting density of the colors corresponds to the sewing sequence of the color-based pattern portions, based on the sewing sequence of the color-based pattern portions.

11. The medium according to claim 9, wherein the embroidery data processing program is configured so that in the assignment routine, the process of randomly extracting colors to be used as the thread color data is repeatedly executed until the colors are extracted which sequentially become darker or lighter than the previously extracted colors.

12. The medium according to claim 9, wherein the embroidery data processing program is configured so that in the assignment routine, the colors corresponding to a total number of the color-based pattern portions are randomly extracted from the colors stored on the color data storage unit, so that the extracted colors are re-arranged in the order of contrasting density of the colors according to the sewing sequence and so that the re-arranged colors are assigned to the respective color-based pattern portions.

13. The medium according to claim 9, wherein the embroidery data processing program further comprises an overlap determination routine of determining whether or not two or more of the color-based pattern portions overlap with each other at least partially, wherein the embroidery data processing program is configured so that a lighter color is assigned to the color-based pattern portion to be sewn relatively earlier in the sewing sequence and so that in the assignment routine, a darker color is assigned to the color-based pattern portion to be sewn relatively later in the sewing sequence, based on a result of determination by the overlap determination routine and the sewing sequence of the color-based pattern portions.

14. The medium according to claim 9, wherein the embroidery data processing program further comprises an overlap number detection routine of detecting a number of overlaps in a case where two or more of the color-based pattern portions overlap at least partially, based on the result of determination by the overlap determination routine, wherein the embroidery data processing program is configured so that in the assignment routine, a lighter color is assigned to the color-based pattern portion to be sewn relatively earlier in the sewing sequence and so that a darker color is assigned to the color-based pattern portion to be sewn relatively later in the sewing sequence, based on the number of overlaps detected by the overlap number detection routine and the sewing sequence of the color-based pattern portions.

15. The medium according to claim 14, wherein the embroidery data processing program further comprises a first allocation routine of allocating the colors stored on the color data storage unit to a plurality of groups according to the number of overlaps, based on contrasting densities of the colors, wherein the embroidery data processing program is configured so that in the assignment routine, colors to be used as thread color data are randomly extracted from the groups corresponding to the respective color-based pattern portions, while an order of contrasting density of the colors is caused to correspond to the sewing sequence of the color-based pattern portions, the order of contrasting density being between or among the groups allocated by the first allocation routine, whereby the extracted colors are assigned to the respective color-based pattern portions.

16. The medium according to claim 9, wherein the embroidery data processing program further comprises a second allocation routine of allocating the colors stored on the color data storage unit to a plurality of groups according to a total number of the color-based pattern portions, based on contrasting densities of the colors, wherein the embroidery data processing program is configured so that in the assignment routine, colors to be used as thread color data are extracted from the groups corresponding to the respective color-based pattern portions, while an order of contrasting density of the colors is caused to correspond to the sewing sequence of the color-based pattern portions, the order of contrasting density being between or among the groups allocated by the second allocation routine, whereby the extracted colors are assigned to the respective color-based portions.

17. A sewing machine which is provided with an embroidery data generating device generating embroidery data and sews an embroidery pattern including a plurality of color-based pattern portions, based on the embroidery data, the embroidery data generating device comprising:

a color data storage unit which stores data of a plurality of defined colors;

an assignment unit which randomly extracts colors from the colors stored on the color data storage unit, the extracted colors being used as thread color data for specifying colors of the color-based pattern portions respectively, the assignment unit assigning the extracted colors to the respective color-based pattern portions; and a sewing sequence data storage unit which stores data of a set sewing sequence of the color-based pattern portions, the device generating embroidery data in which an order of contrasting density of the colors assigned to the respective color-based pattern portions by the assignment unit as the thread color data corresponds to a sewing sequence of the color-based pattern portions.

* * * * *